US009873981B2

(12) United States Patent
Edbauer et al.

(10) Patent No.: US 9,873,981 B2
(45) Date of Patent: Jan. 23, 2018

(54) DOCTOR CONTROL SYSTEMS FOR PAPERMAKING MACHINES AND RELATED METHODS

(71) Applicant: GPCP IP Holdings LLC, Atlanta, GA (US)

(72) Inventors: Mitchell S. Edbauer, Green Bay, WI (US); Ross C. Bons, Little Chute, WI (US); Jason A. Haines, Lena, WI (US); Scott M. Thomson, Lena, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 15/209,806

(22) Filed: Jul. 14, 2016

(65) Prior Publication Data

US 2017/0016181 A1 Jan. 19, 2017

Related U.S. Application Data

(60) Provisional application No. 62/193,372, filed on Jul. 16, 2015.

(51) Int. Cl.
*D21F 11/14* (2006.01)
*D21G 3/00* (2006.01)
*D21G 3/04* (2006.01)

(52) U.S. Cl.
CPC ..... *D21G 3/005* (2013.01); *D21F 11/14* (2013.01); *D21G 3/04* (2013.01)

(58) Field of Classification Search
CPC ..... D21F 11/14; D21G 9/0036; D21G 3/005; D21G 3/04; D21G 3/00
(Continued)

(56) References Cited

U.S. PATENT DOCUMENTS 4,919,756 A 4/1990 Sawdai et al.
5,108,794 A 4/1992 Kinnunen et al.
(Continued)

FOREIGN PATENT DOCUMENTS

DE 10214392 A1 10/2003
EP 2573264 A1 3/2013
(Continued)

OTHER PUBLICATIONS

International Search Report and Written Opinion of the International Searching Authority, dated Oct. 10, 2016 in International Patent Application No. PCT/US2016/042385.

*Primary Examiner* — Mark Halpern
(74) *Attorney, Agent, or Firm* — Laura L. Bozek

(57) ABSTRACT

A papermaking machine includes a Yankee dryer, a doctor, and a doctor blade loading control system. The doctor blade loading control system includes a first doctor loading cylinder coupled to the doctor and configured to selectively apply a loading force to the doctor, a second doctor loading cylinder coupled to the doctor and configured to selectively apply a loading force to the doctor, a first air line in communication with the first doctor loading cylinder, a second air line in communication with the second doctor loading cylinder, a first electronic pressure controller configured to control a loading pressure of the first doctor loading cylinder on the doctor based on a first loading pressure setpoint, and a second electronic pressure controller configured to control a loading pressure of the second doctor loading cylinder on the doctor based on a second loading pressure setpoint.

20 Claims, 13 Drawing Sheets

(58) Field of Classification Search
USPC ..... 162/262
See application file for complete search history.

(56) References Cited

U.S. PATENT DOCUMENTS

| | | | |
|---|---|---|---|
| 5,489,364 | A | 2/1996 | Marinack |
| 5,674,361 | A | 10/1997 | Marinack |
| 5,783,042 | A | 7/1998 | Leeman et al. |
| 5,944,958 | A | 8/1999 | Svanqvist et al. |
| 6,071,550 | A | 6/2000 | Ueberschar et al. |
| 6,830,659 | B2 | 12/2004 | Sovijaervi |
| 6,849,290 | B2 | 2/2005 | Mäkinen et al. |
| 7,108,766 | B1 | 9/2006 | Eskelinen et al. |
| 7,264,692 | B2 | 9/2007 | Isometsä et al. |
| 8,337,668 | B2 | 12/2012 | Berendes et al. |
| 2015/0075742 | A1 | 3/2015 | Johnson et al. |

FOREIGN PATENT DOCUMENTS

| | | | |
|---|---|---|---|
| WO | 2004005614 | A1 | 1/2004 |
| WO | 2012013857 | A1 | 2/2012 |

DOCTOR CONTROL SYSTEMS FOR PAPERMAKING MACHINES AND RELATED METHODS

CROSS-REFERENCE TO RELATED APPLICATION

This application is based on and claims the benefit of U.S. Provisional Patent Application No. 62/193,372, filed on Jul. 16, 2015, which is incorporated by reference herein in its entirety.

FIELD OF THE DISCLOSURE

The present disclosure relates generally to papermaking machines and more particularly to doctor control systems for papermaking machines and related methods for controlling loading of doctor blades and monitoring vibration of doctor blades.

BACKGROUND OF THE DISCLOSURE

Papermaking machines generally may be used to manufacture paper products by suspending cellulosic fibers of appropriate length in an aqueous medium, forming the fibers into a wet web, and then removing most of the water from the fibrous web. In the manufacture of absorbent paper products, such as bath tissue, facial tissue, paper towels, paper napkins, and wipers, creping may be performed in order to impart desired aesthetic and performance properties to the resulting paper product. Creping is a process of mechanically foreshortening a fibrous structure in the machine direction in order to enhance bulk, stretch, and perceived softness of the resulting paper product.

After forming the wet fibrous web, partial drying of the web may be achieved by various known methods, such as conventional wet pressing (CWP) or through-air-drying (TAD). The semi-dry fibrous web then may be transferred via a pressure roll to a large, rotating cylindrical dryer, known in the industry as a Yankee dryer, for further drying followed by creping. In particular, the fibrous web may be adhered to the surface of the heated Yankee dryer and rotated therewith to facilitate water removal by evaporation, which may be aided by a dryer hood positioned about the Yankee dryer. The substantially dry fibrous web may be removed from the Yankee dryer surface by a creping blade, a type of doctor blade configured to crepe the fibrous web as the web is separated from the Yankee dryer. Finally, the creped web may be directed through calender rollers and then wound onto a reel prior to further converting operations, such as embossing.

A coating generally may be applied to the cylindrical surface of the Yankee dryer to facilitate adhesion of the fibrous web thereto for adequate drying and creping and also to protect the Yankee dryer surface from corrosion and direct contact with the creping blade. The coating may be made up of various materials, including one or more adhesives, releases, and/or modifiers, as may be desired in certain applications. Excessive build-up or uneven distribution of the coating, particularly creping adhesives, may be addressed by a cleaning blade, a type of doctor blade positioned after the creping blade and configured to remove a portion of the coating from the Yankee dryer surface after removal of the dry fibrous web. Additional coating materials may be applied to the Yankee dryer surface via a spray boom positioned between the cleaning blade and the pressure roll in order to maintain an adequate layer of the coating for subsequent adhesion of the semi-dry fibrous web and creping.

The creping blade generally experiences wear during continued operation of the papermaking machine, which may compromise the creping process and affect the quality of the resulting paper product. Accordingly, periodic replacement of the creping blade may be required to maintain desired creping performance and characteristics of the paper product. During a change-out of the creping blade, the fibrous web adhered to the Yankee dryer may be engaged by a cut-off blade, a type of doctor blade positioned before the creping blade and configured to cut the fibrous web and direct the web to a pulper until the change-out is complete and creping is resumed. The frequency of creping blade change-outs may vary depending upon the operating conditions, the type of blade being used, and the type of paper product being produced.

Various mechanisms have been developed for positioning and loading doctor blades, such as creping blades, cleaning blades, and cut-off blades, against the coated surface of a Yankee dryer. For example, certain existing papermaking machines may include one or more loading cylinders for each doctor, which may operate via air pressure to force the respective doctor blade into engagement with the coated Yankee dryer surface to perform its respective function. The loading pressure of the cylinders on the respective doctor may be visually observed via simple dial pressure gauges and manually adjusted via pressure regulators in an effort to improve performance of the doctor blade. However, such doctor blade loading systems may present several shortcomings.

First, according to existing doctor blade loading systems, the dial pressure gauges may not provide accurate readings of the actual loading pressures of the cylinders, and the pressure regulators may not allow for precise adjustment and control of the loading pressures. Second, such doctor blade loading systems may lack any means for tracking changes in the loading pressures of the cylinders and for indicating whether such changes were the result of operator adjustment at specific times or merely drift of the loading pressures over time. Accordingly, troubleshooting of certain performance problems, such as excessive coating build-up or uneven coating distribution on the Yankee dryer surface, excessive wear of the creping blade, or inadequate creping of the fibrous web, may be difficult to address. Third, existing doctor blade loading systems may lack any means for monitoring vibration of the doctor blades and making necessary adjustments to address blade "chatter," which may cause inadequate creping of the fibrous web as well as damage to the coating layer, the Yankee dryer surface, and/or the doctor blades. These shortcomings may result in low quality paper product and increased wear of the doctor blades, necessitating frequent troubleshooting of the creping process and change-outs of the blades, which ultimately increase operating costs and decrease operating efficiency.

There is thus a desire for improved doctor control systems for papermaking machines and related methods for controlling loading of doctor blades and monitoring vibration of doctor blades. Such control systems and methods should address one or more of the shortcomings described above in order to decrease operating costs and increase operating efficiency of the papermaking machine.

SUMMARY OF THE DISCLOSURE

In one aspect, a papermaking machine for manufacturing a paper product is provided. The papermaking machine includes a Yankee dryer configured to rotate about an axis thereof, a doctor positioned about the Yankee dryer, and a doctor blade loading control system in communication with the doctor. The doctor includes a doctor blade supported by a doctor blade holder. The doctor blade loading control system includes a first doctor loading cylinder coupled to a tend side of the doctor and configured to selectively apply a loading force to the doctor, a second doctor loading cylinder coupled to a drive side of the doctor and configured to selectively apply a loading force to the doctor, a first air line in communication with a load side of the first doctor loading cylinder and configured to deliver air thereto, a second air line in communication with a load side of the second doctor loading cylinder and configured to deliver air thereto, a first electronic pressure controller disposed along the first air line and configured to control a loading pressure of the first doctor loading cylinder on the doctor based on a first loading pressure setpoint, and a second electronic pressure controller disposed along the second air line and configured to control a loading pressure of the second doctor loading cylinder on the doctor based on a second loading pressure setpoint.

In another aspect, a method for controlling loading of a doctor blade of a papermaking machine is provided. The method includes the steps of positioning a doctor about a Yankee dryer, the doctor comprising a doctor blade supported by a doctor blade holder; applying, via a first doctor loading cylinder, a loading force to a tend side of the doctor; applying, via a second doctor loading cylinder, a loading force to a drive side of the doctor; controlling, via a first electronic pressure controller, a loading pressure of the first doctor loading cylinder on the doctor based on a first loading pressure setpoint; and controlling, via a second electronic pressure controller, a loading pressure of the second doctor loading cylinder on the doctor based on a second loading pressure setpoint.

In still another aspect, a papermaking machine for manufacturing a paper product is provided. The papermaking machine includes a Yankee dryer configured to rotate about an axis thereof, a doctor positioned about the Yankee dryer, and a doctor blade vibration monitoring system in communication with the doctor. The doctor includes a doctor blade supported by a doctor blade holder. The doctor blade vibration monitoring system includes an accelerometer mounted to the doctor and configured to measure or detect vibration of the doctor blade, and a vibration transmitter in communication with the accelerometer and configured to receive a vibration signal therefrom. The papermaking machine also includes a system controller in communication with the vibration transmitter and configured to receive the vibration signal therefrom.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings, which are not necessarily drawn to scale. The drawings illustrate embodiments of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION OF THE DISCLOSURE

Figure 1:
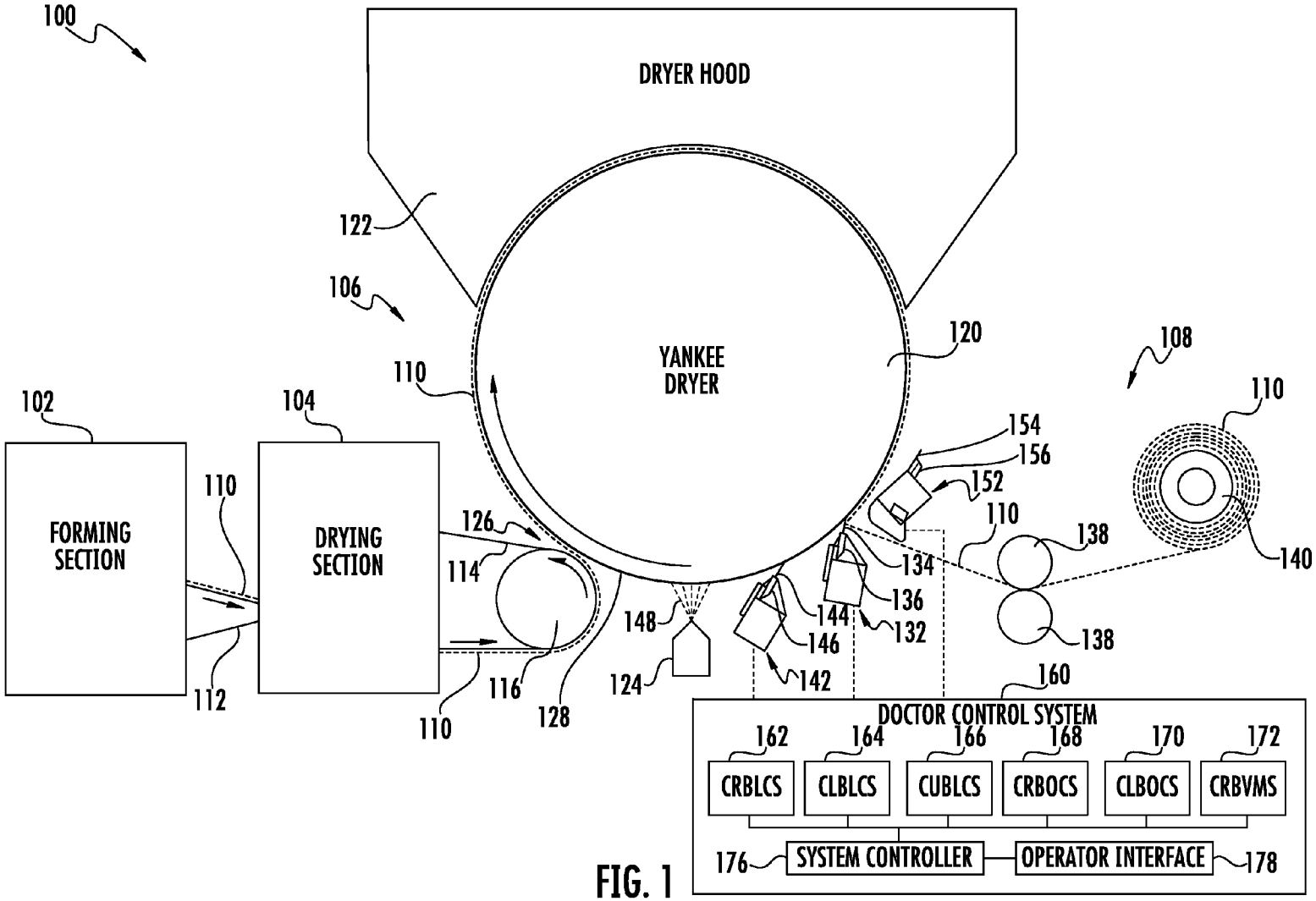
FIG. 1 is a schematic diagram of a papermaking machine in accordance with one or more embodiments of the present disclosure.

Various embodiments of the present disclosure provide improved doctor control systems for papermaking machines and related methods for controlling loading of doctor blades and monitoring vibration of doctor blades. Such doctor control systems and methods may address one or more of the above-described shortcomings of existing technology for papermaking machines. In particular, the doctor control systems described herein advantageously may provide accurate readings of the loading pressures of loading cylinders on doctors controlled thereby and may allow for precise adjustment and control of the loading pressures. The doctor control systems also may track changes in the loading pressures of the cylinders over time, such as changes resulting from operator adjustment, which may facilitate troubleshooting of certain performance problems relating to coating buildup or distribution, wear of the doctor blades, or quality of the creping process. Furthermore, the doctor control systems may monitor vibration of the doctor blades and make necessary adjustments, or allow for such adjustments to be made, to address blade "chatter," which may ensure adequate creping of the fibrous web and inhibit damage to the coating layer, the Yankee dryer surface, and the doctor blades. Ultimately, the control systems and methods described herein may facilitate production of high quality paper products and decrease wear of the doctor blades, thereby decreasing the frequency of blade change-outs, decreasing operating costs, and increasing operating efficiency of the papermaking machine.

The present disclosure includes non-limiting embodiments of papermaking machines, doctor control systems, and related methods for controlling loading of doctor blades and monitoring vibration of doctor blades. The embodiments are described in detail herein to enable one of ordinary skill in the art to practice the papermaking machines, doctor control systems, and related methods, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably. The meanings of terms used herein will be apparent to one of ordinary skill in the art or will become apparent to one of ordinary skill in the art upon review of the detailed description when taken in conjunction with the several drawings and the appended claims.

FIG. 1 illustrates a papermaking machine 100 according to one or more embodiments of the disclosure. The papermaking machine 100 may be used to manufacture paper products by suspending cellulosic fibers of appropriate length in an aqueous medium, forming the fibers into a wet web, and then removing most of the water from the fibrous web. In particular, the papermaking machine 100 may be used to manufacture absorbent paper products, such as bath tissue, facial tissue, paper towels, paper napkins, and wipers, which may be creped as described below. Various systems and components of the papermaking machine 100 are illustrated in FIGS. 1-10. It will be appreciated that the papermaking machine 100 may include systems and/or components in addition to those illustrated in the drawings, and that the systems and components of the machine 100 may have other configurations.

As shown, the papermaking machine 100 may include a forming section 102, a drying section 104, a creping section 106, and a rolling section 108. The forming section 102 may be configured to form a fibrous web 110 (shown via a dashed line in FIG. 1) from a liquid slurry of pulp, water, and various chemicals. The forming section 102 may include any known forming system configured to facilitate formation of the web 110 and initial removal of water therefrom. For example, the forming section 102 may include a crescent former, a C-wrap twin-wire former, an S-wrap twin-wire former, a suction breast roll former, or a Fourdrinier wire, although other forming systems may be used. The wet fibrous web 110 may be transferred from the forming section 102 to the drying section 104 for partial drying of the web 110. As shown, the wet fibrous web 110 may be transferred to the drying section 104 via a moving carrier fabric 112, although other mechanisms may be used. The drying section 104 may include various components for carrying out any known drying process, such as conventional wet pressing (CWP) or through-air-drying (TAD). The semi-dry fibrous web 110 then may be transferred from the drying section 104 to the creping section 106 for further drying of the web 110 followed by creping of the web 110. As shown, the semi-dry fibrous web 110 may be transferred to the creping section 106 via a moving carrier fabric 114 and a pressure roll 116, although other mechanisms, such as a shoe press, may be used.

The creping section 106 of the papermaking machine 100 may include a Yankee dryer 120, a dryer hood 122, a spray boom 124, and a plurality of doctors. The pressure roll 116 and the Yankee dryer 120 may form a nip 126 therebetween and may rotate as indicated by the arrows shown. In this manner, the semi-dry fibrous web 110 may be transferred from the carrier fabric 114 to the outer cylindrical surface of the Yankee dryer 120 and then rotate along with the Yankee dryer 120. A coating 128 may be disposed on the outer cylindrical surface of the Yankee dryer 120 to facilitate adhesion of the fibrous web 110 thereto. The coating 128 may be made up of various materials known in the art, including one or more adhesives, releases, and/or modifiers. The dryer hood 122 may be positioned about and partially enclose the Yankee dryer 120, as shown. As the fibrous web 110 rotates with the Yankee dryer 120, further drying of the web 110 may be achieved by evaporation facilitated by heating of the Yankee dryer 120 and hot air directed at the web 110 via the dryer hood 122.

The substantially dry fibrous web 110 may be removed from the surface of the Yankee dryer 120 by a creping doctor 132, as shown. The creping doctor 132 may include a creping doctor blade 134 (which may be referred to simply as a "creping blade") supported by a creping doctor blade holder 136 (which may be referred to simply as a "creping blade holder"). The creping blade 134 may be configured to crepe the fibrous web 110 as the web 110 is separated thereby from the Yankee dryer 120. As the fibrous web 110 is removed from the surface of the Yankee dryer 120, the creping blade 134 also may remove a small portion of the layer of the coating 128. In other words, the creping blade 134 may cut partially into the coating 128 when separating the fibrous web 110 from the Yankee dryer 120. The creped fibrous web 110 then may be transferred to the rolling section 108 of the papermaking machine 100, which may include a plurality of calender rollers 138 and a reel 140. The calender rollers 138 may be configured to smooth out the creped fibrous web 110, and the reel 140 may be configured to wind the web 110 into a roll for storage prior to any further converting operations, such as embossing.

A desired layer of the coating 128 on the outer cylindrical surface of the Yankee dryer 120 may be maintained by a cleaning doctor 142 and the spray boom 124. As shown, the cleaning doctor 142 may be positioned after the creping doctor 132, and the spray boom 124 may be positioned after the cleaning doctor 142 and before the pressure roll 116. The cleaning doctor 142 may include a cleaning doctor blade 144 (which may be referred to simply as a "cleaning blade") supported by a cleaning doctor blade holder 146 (which may be referred to simply as a "cleaning blade holder"). The cleaning blade 144 may be configured to remove a portion of the coating 128 from the surface of the Yankee dryer 120 after the dry fibrous web 110 has been removed therefrom by the creping blade 134. In this manner, the cleaning blade 144 may address excessive build-up or uneven distribution of the coating 128, as may occur during continued operation of the papermaking machine 100. The spray boom 124 may be configured to apply additional coating materials 148, such as creping adhesives, to the surface of the Yankee dryer 120 in order to provide an adequate layer of the coating 128 for subsequent adhesion of the semi-dry fibrous web 110 and creping.

Due to blade wear experienced during continued operation of the papermaking machine 100, periodic replacement of the creping blade 134 may be required to maintain desired creping performance and characteristics of the resulting paper product. During a change-out of the creping blade 134, a cut-off doctor 152 may be used to remove the substantially dry fibrous web 110 from the Yankee dryer 120 and redirect the web 110 as desired. As shown, the cut-off doctor 152 may be positioned before the creping doctor 132. The cut-off doctor 152 may include a cut-off doctor blade 154 (which may be referred to simply as a "cut-off blade") supported by a cut-off doctor blade holder 156 (which may be referred to simply as a "cut-off blade holder"). The cut-off blade 154 may be configured to cut the fibrous web 110 and direct the web 110 to a pulper until the change-out of the creping blade 134 is complete and creping is resumed.

As shown in FIG. 1, the papermaking machine 100 may include a doctor control system 160 in communication with the creping doctor 132, the cleaning doctor 142, and the cut-off doctor 152. The doctor control system 160 may include a creping blade loading control system (CRBLCS) 162, a cleaning blade loading control system (CLBLCS) 164, a cut-off blade loading control system (CUBLCS) 166, a creping blade oscillating control system (CRBOCS) 168, a cleaning blade oscillating control system (CLBOCS) 170, and a creping blade vibration monitoring system (CRBVMS) 172. The components and operation of these systems are described in detail below with reference to FIGS. 2-10. The doctor control system 160 also may include one or more system controllers 176 in communication with the CRBLCS 162, the CLBLCS 164, the CRBLCS 166, the CRBOCS 168, the CLBOCS 170, and the CRBVMS 172, and an operator interface 178 in communication with the system controller 176. It will be appreciated that the doctor control system 160 may include systems and/or components in addition to those illustrated in the drawings, and that the systems and components of the doctor control system 160 may have other configurations.

Figure 2:
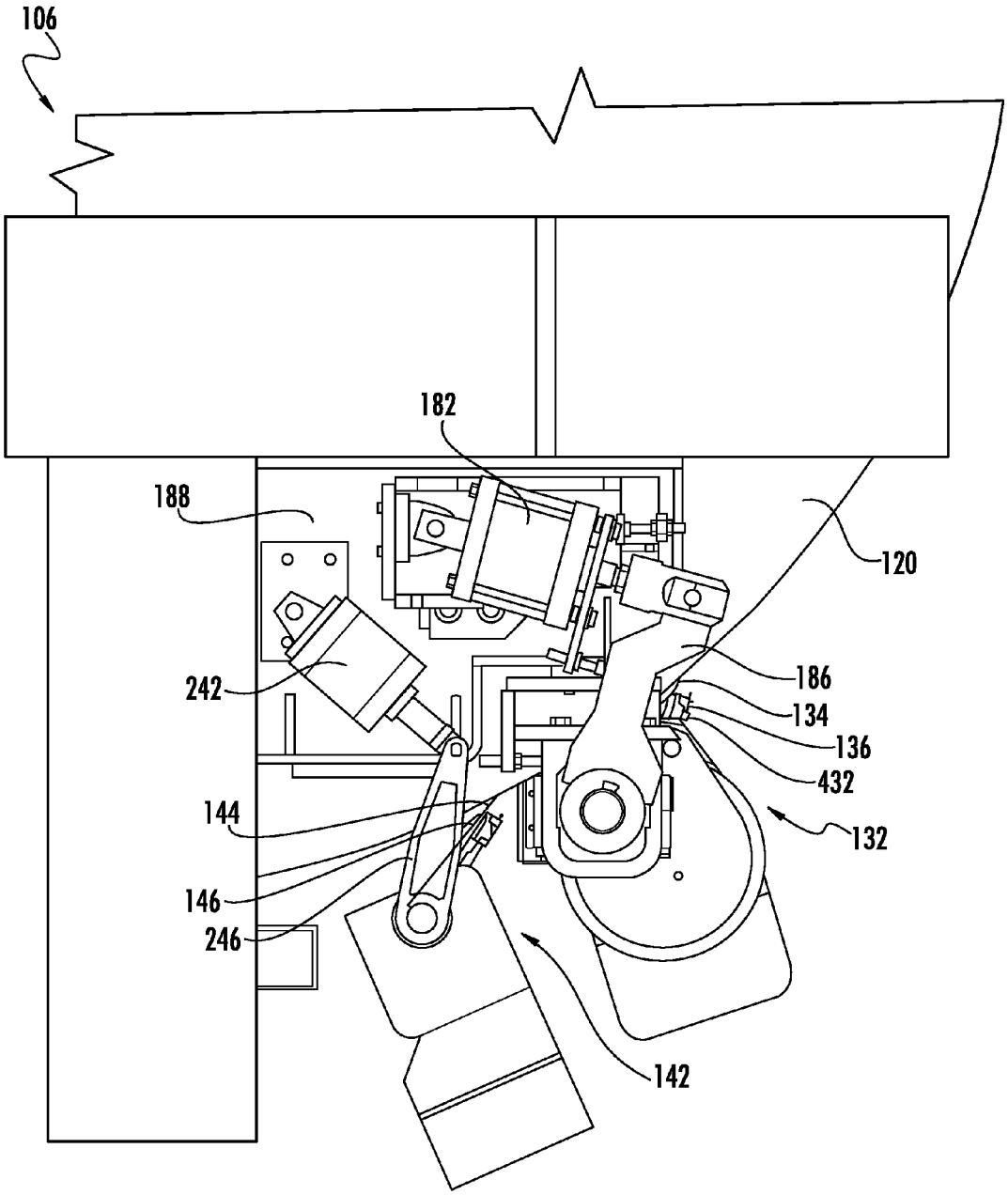
FIG. 2 is a detailed side view of a portion of the papermaking machine of FIG. 1, including a Yankee dryer, a creping doctor, a creping doctor loading cylinder, a cleaning doctor, a cleaning doctor loading cylinder, and a support structure.
Figure 3A:
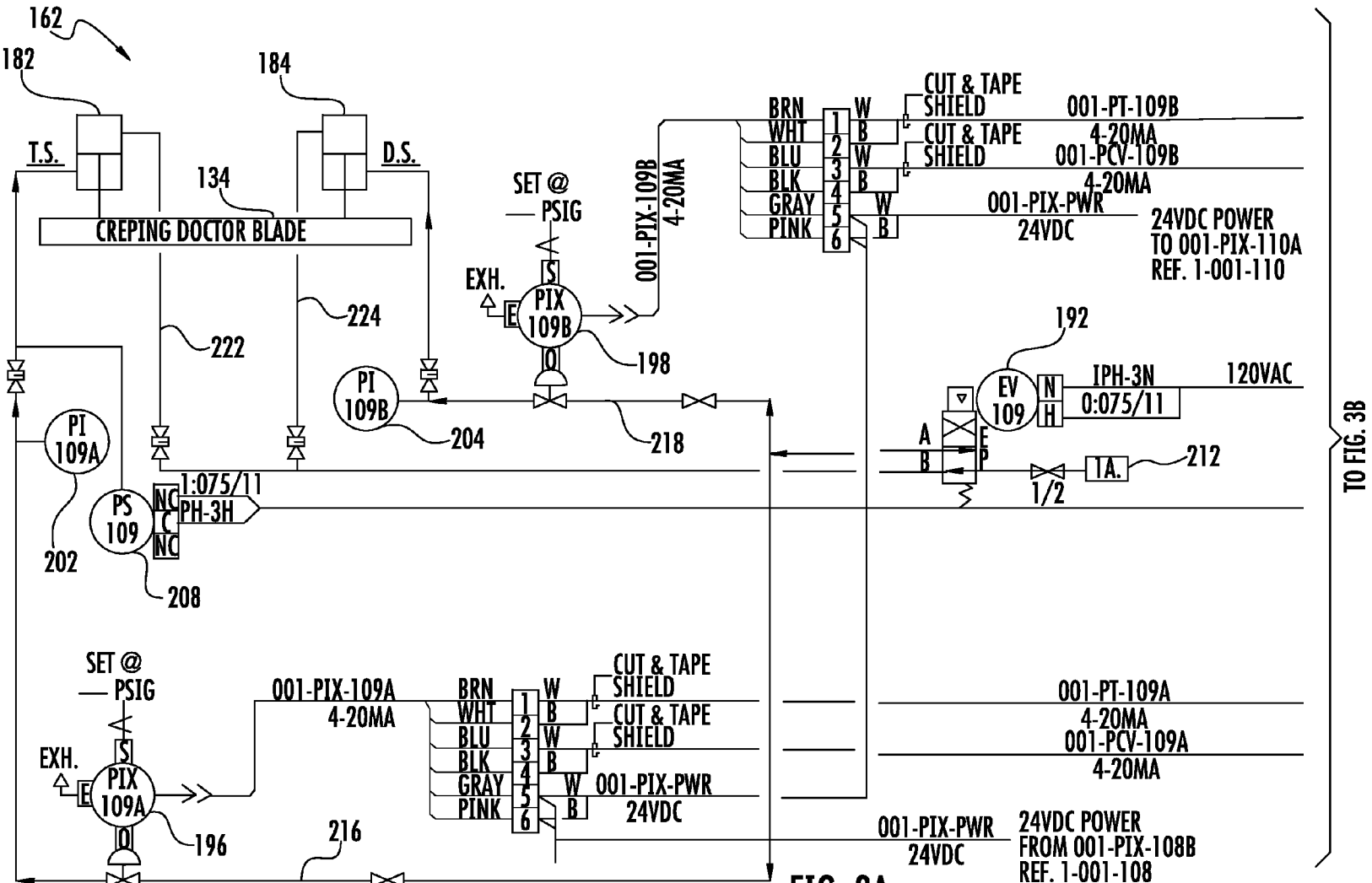
FIG. 3A is a schematic diagram of a portion of the papermaking machine of FIG. 1, including a portion of a loading control system for a creping doctor blade.
Figure 3B:
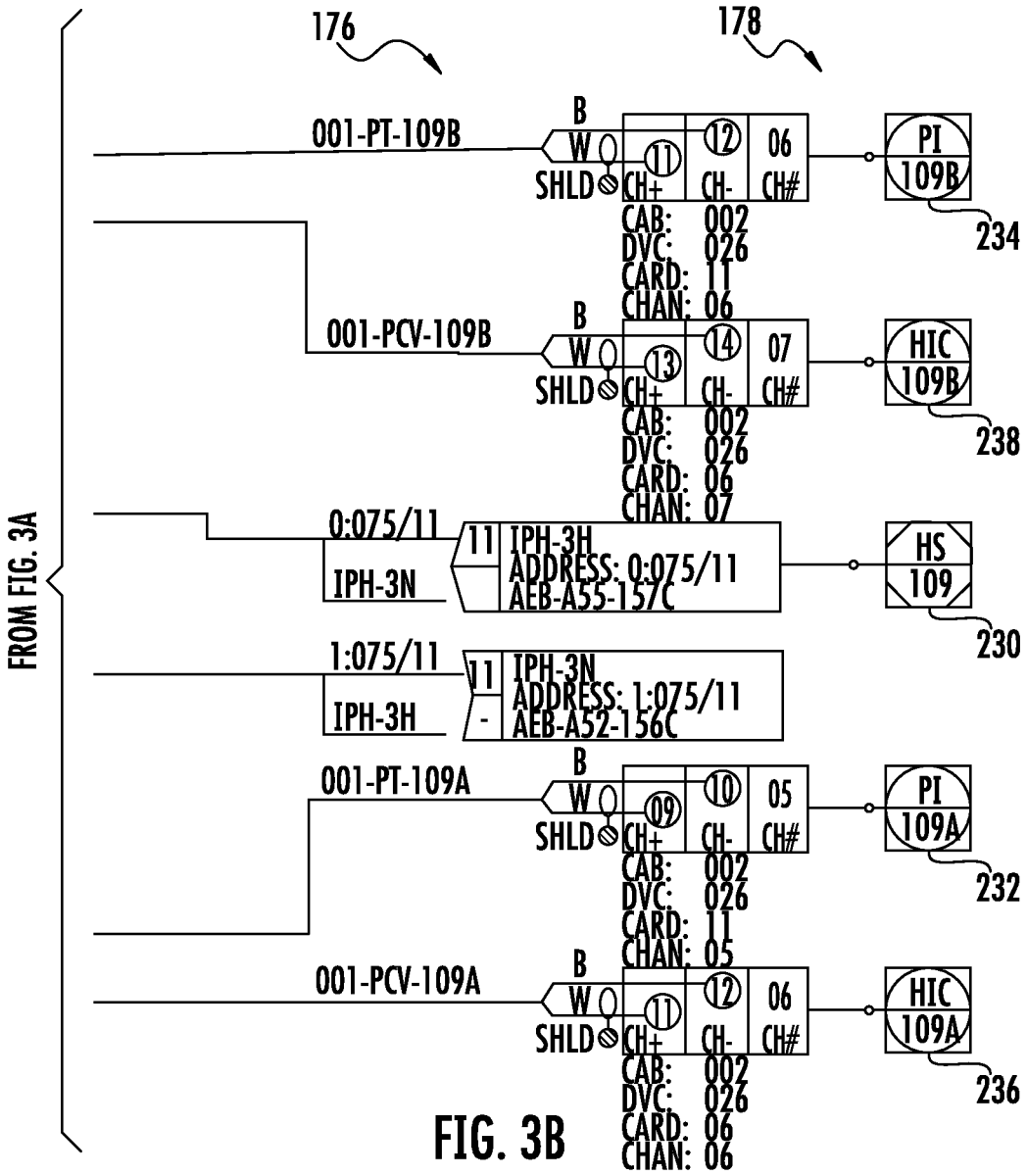
FIG. 3B is a schematic diagram of a portion of the papermaking machine of FIG. 1, including a portion of the loading control system for a creping doctor blade.

The creping blade loading control system (CRBLCS) 162, illustrated in detail in FIGS. 3A and 3B, and with reference to FIG. 2, may be operable to control positioning and loading of the creping blade 134 against the coated outer surface of the Yankee dryer 120. The CRBLCS 162 may include a pair of creping doctor loading cylinders 182, 184 coupled to the creping doctor 132 and configured to selectively apply a loading force or an unloading force to the creping doctor 132 such that the creping blade 134 is forced into engagement with or out of engagement with the coated outer surface of the Yankee dryer 120. In particular, the first creping doctor loading cylinder 182 (which also may be referred to as a "tend side creping doctor loading cylinder") may be coupled to the tend side of the creping doctor 132, and the second creping doctor loading cylinder 184 (which also may be referred to as a "drive side creping doctor loading cylinder") may be coupled to the drive side of the creping doctor 132. Each of the creping doctor loading cylinders 182, 184 may be respectively coupled to the creping doctor 132 via a control arm 186. Additionally, the creping doctor loading cylinders 182, 184 may be respectively coupled to a support structure 188 positioned about the Yankee dryer 120, as shown.

The creping doctor loading cylinders 182, 184 may be operated via air pressure to selectively apply a loading force or an unloading force to the creping doctor 132. As shown in FIG. 3A, the CRBLCS 162 may include an electronic solenoid valve 192, a pair of electronic pressure controllers 196, 198, a pair of pressure indicators 202, 204, a pressure switch 208, and a plurality of air lines. The electronic solenoid valve 192 may be in communication with an air source 212 and configured to control air flow to and from the creping doctor loading cylinders 182, 184 via the air lines, as shown. In particular, the electronic solenoid valve 192 may be configured to control inlet air flow from the air source 212 to the creping doctor loading cylinders 182, 184 and exhaust air flow from the creping doctor loading cylinders 182, 184 to one or more exhaust lines. A first air line 216 may be disposed between the electronic solenoid valve 192 and a load side of the first creping doctor loading cylinder 182. In this manner, the first air line 216 may be configured to deliver inlet air to the load side of the loading cylinder 182 and to receive exhaust air from the load side of the loading cylinder 182. The first electronic pressure controller 196 may be disposed along the first air line 216 and configured to control the pressure of the air delivered to the load side of the first creping doctor loading cylinder 182 (i.e., the loading pressure of the loading cylinder 182 on the creping doctor 132). The first pressure indicator 202 may be disposed along the first air line 216 downstream of the first electronic pressure controller 196 and configured to indicate (i.e., display) the actual pressure of the air delivered to the load side of the first creping doctor loading cylinder 182 (i.e., the actual loading pressure of the loading cylinder 182 on the creping doctor 132). The pressure switch 208 may be disposed along the first air line 216 downstream of the first pressure indicator 202 and configured to indicate that pressurized air is present in the first air line 216.

In a similar manner, a second air line 218 may be disposed between the electronic solenoid valve 192 and a load side of the second creping doctor loading cylinder 184. In this manner, the second air line 218 may be configured to deliver inlet air to the load side of the loading cylinder 184 and to receive exhaust air from the load side of the loading cylinder 184. The second electronic pressure controller 198 may be disposed along the second air line 218 and configured to control the pressure of the air delivered to the load side of the second creping doctor loading cylinder 184 (i.e., the loading pressure of the loading cylinder 184 on the creping doctor 132). The second pressure indicator 204 may be disposed along the second air line 218 downstream of the second electronic pressure controller 198 and configured to indicate the actual pressure of the air delivered to the load side of the second creping doctor loading cylinder 184 (i.e., the actual loading pressure of the loading cylinder 184 on the creping doctor 132). A third air line 222 may be disposed between the electronic solenoid valve 192 and an un-load side of the first creping doctor loading cylinder 182. In this manner, the third air line 222 may be configured to deliver inlet air to the un-load side of the loading cylinder 182 and to receive exhaust air from the un-load side of the loading cylinder 182. In a similar manner, a fourth air line 224 may be disposed between the electronic solenoid valve 192 and an un-load side of the second creping doctor loading cylinder 184. In this manner, the fourth air line 224 may be configured to deliver inlet air to the un-load side of the loading cylinder 184 and to receive exhaust air from the un-load side of the loading cylinder 184.

As shown, the electronic solenoid valve 192, the electronic pressure controllers 196, 198, and the pressure switch 208 may be in communication with a portion of the system controller 176 and configured to send respective signals to the system controller 176 and/or receive respective signals from the system controller 176 in accordance with the respective functions of the components. As described above, the system controller 176 may be in communication with the operator interface 178, which may include a hand switch 230, a pair of pressure indicators 232, 234, and a pair of hand indicating controllers 236, 238. The hand switch 230 may be configured to open and close the electronic solenoid valve 192, upon actuation of the hand switch 230 by an operator, to control the flows of inlet air from the air source 212 to the creping doctor loading cylinders 182, 184 and the flows of exhaust air from the creping doctor loading cylinders 182, 184 to one or more exhaust lines. The first pressure indicator 232 may be configured to indicate (i.e., display) the actual loading pressure of the first creping doctor loading cylinder 182 on the creping doctor 132, based upon a signal received by the system controller 176 from the first electronic pressure controller 196. The first hand indicating controller 236 may be configured to establish, adjust, and indicate a setpoint for the loading pressure of the first creping doctor loading cylinder 182 on the creping doctor 132. Upon actuation of the first hand indicating controller 236 by an operator to establish or adjust a setpoint, the system controller 176 may send a signal to the first electronic pressure controller 196 to maintain the setpoint. In a similar manner, the second pressure indicator 234 may be configured to indicate (i.e., display) the actual loading pressure of the second creping doctor loading cylinder 184 on the creping doctor 132, based upon a signal received by the system controller 176 from the second electronic pressure controller 198. The second hand indicating controller 238 may be configured to establish, adjust, and indicate a setpoint for the loading pressure of the second creping doctor loading cylinder 184 on the creping doctor 132. Upon actuation of the second hand indicating controller 238 by an operator to establish or adjust a setpoint, the system controller 176 may send a signal to the second electronic pressure controller 198 to maintain the setpoint. In some embodiments, the loading pressure setpoints for the first electronic pressure controller 196 and the second electronic pressure controller 198 may be the same (i.e., equal to one another). In other embodiments, the loading pressure setpoints for the first electronic pressure controller 196 and the second electronic pressure controller 198 may be different from one another, such that loading of the creping doctor 132 is biased toward the tend side or the drive side thereof.

During operation of the papermaking machine 100, the CRBLCS 162 may provide a high-speed closed-loop system for remotely controlling positioning and loading of the creping blade 134 against the coated outer surface of the Yankee dryer 120. In particular, the electronic pressure controllers 196, 198 may provide precise control of the loading pressures of the creping doctor loading cylinders 182, 184 on the creping doctor 132, based on setpoints that may be established and adjusted by an operator via the hand indicating controllers 236, 238. In this manner, the electronic pressure controllers 196, 198 may prevent drift of the loading pressures over time. The pressure indicators 232, 234 may provide accurate real-time readings of the actual loading pressures of the creping doctor loading cylinders 182, 184 on the creping doctor 132. The system controller 176 may include a memory that stores data relating to the loading pressure setpoints and the actual loading pressures of the loading cylinders 182, 184 during operation of the papermaking machine 100. In this manner, the system controller 176 may track changes in the loading pressure setpoints and the actual loading pressures over time, which may facilitate troubleshooting of certain performance problems, such as wear of the creping blade 134 or quality of the creping process. In particular, the operator interface 178 may be configured to graphically display the loading pressure setpoint data and the actual loading pressure data over time, such that an operator may review significant changes or trends and may determine any desired adjustments to the loading pressure setpoints. Ultimately, the CRBLCS 162 may be used to optimize the loading pressures of the loading cylinders 182, 184 to the lowest values that maintain reliable operation of the creping blade 134 (which may be referred to as the "lowest reliable loading pressure"). Such optimization may decrease wear of the creping blade 134, thereby decreasing the frequency of blade change-outs, decreasing operating costs, and increasing operating efficiency. It will be understood that the loading pressures of the loading cylinders 182, 184 on the creping doctor 132 correlate to a blade pressure of the creping blade 134 on the outer surface of the Yankee dryer 120, and that conversion charts may be used to determine the blade pressure resulting from certain loading pressure setpoints.

Figure 4A:
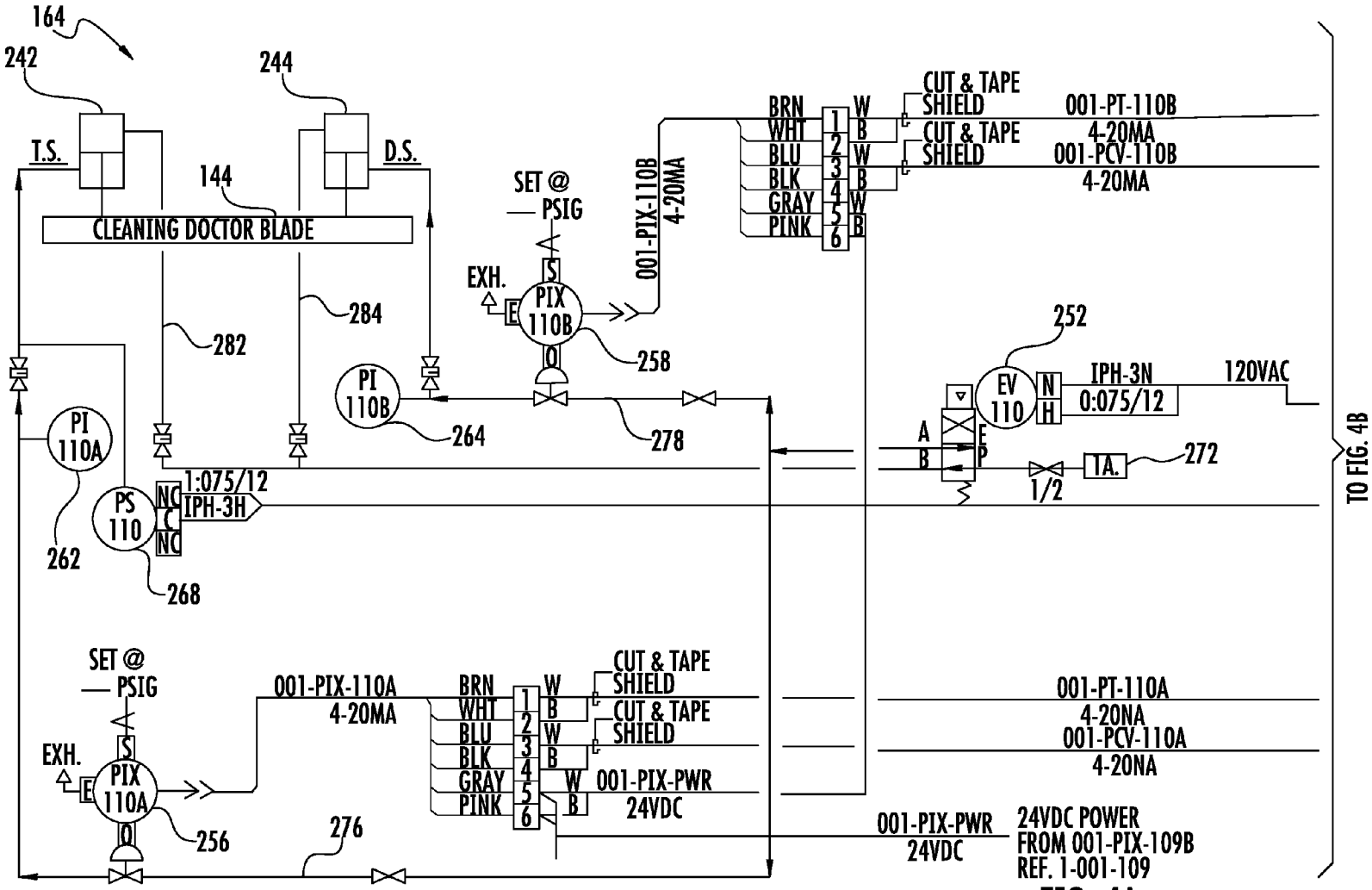
FIG. 4A is a schematic diagram of a portion of the papermaking machine of FIG. 1, including a portion of a loading control system for a cleaning doctor blade.
Figure 4B:
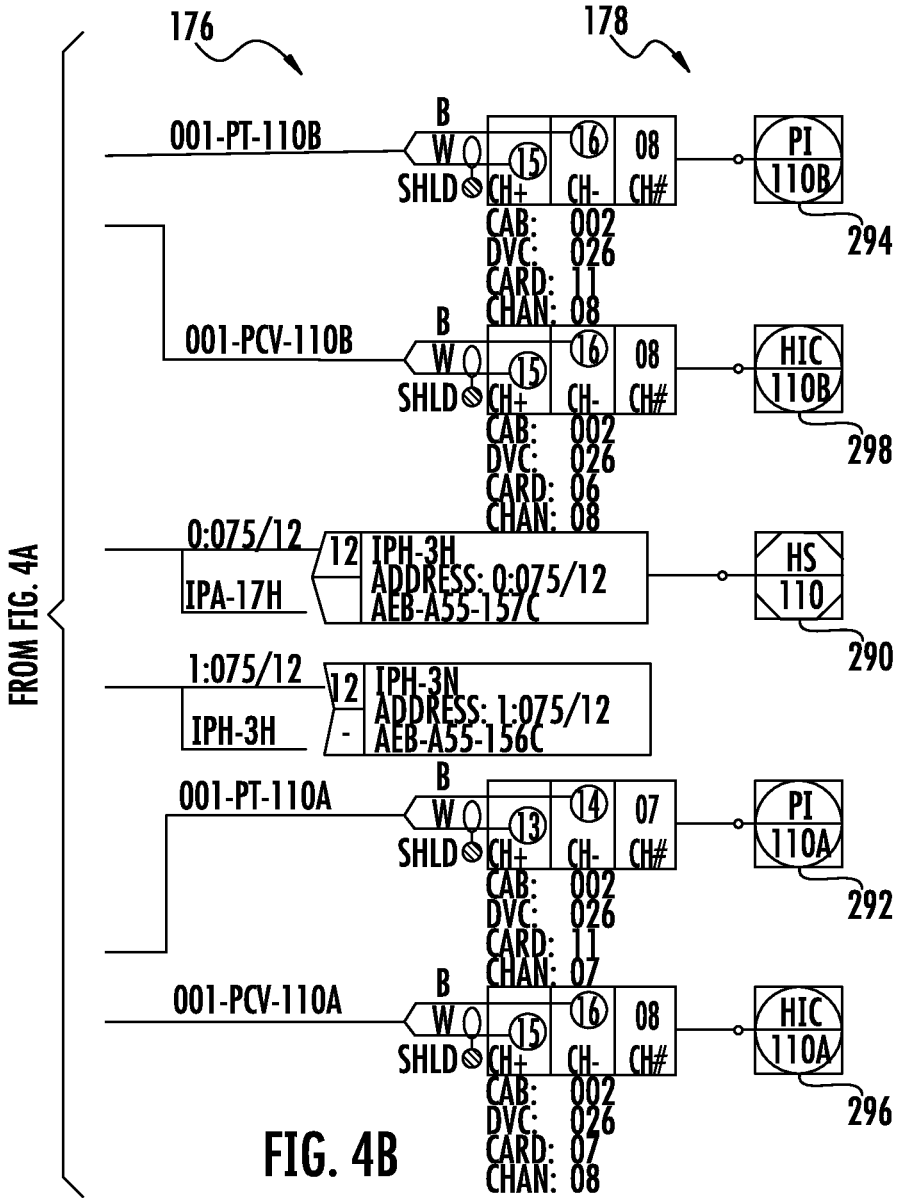
FIG. 4B is a schematic diagram of a portion of the papermaking machine of FIG. 1, including a portion of the loading control system for a cleaning doctor blade.

The cleaning blade loading control system (CLBLCS) 164, illustrated in detail in FIGS. 4A and 4B, and with reference to FIG. 2, may be operable to control positioning and loading of the cleaning blade 144 against the coated outer surface of the Yankee dryer 120. The CLBLCS 164 may include a pair of cleaning doctor loading cylinders 242, 244 coupled to the cleaning doctor 142 and configured to selectively apply a loading force or an unloading force to the cleaning doctor 142 such that the cleaning blade 144 is forced into engagement with or out of engagement with the coated outer surface of the Yankee dryer 120. In particular, the first cleaning doctor loading cylinder 242 (which also may be referred to as a "tend side cleaning doctor loading cylinder") may be coupled to the tend side of the cleaning doctor 142, and the second cleaning doctor loading cylinder 244 (which also may be referred to as a "drive side cleaning doctor loading cylinder") may be coupled to the drive side of the cleaning doctor 142. Each of the cleaning doctor loading cylinders 242, 244 may be respectively coupled to the cleaning doctor 142 via a control arm 246. Additionally, the cleaning doctor loading cylinders 242, 244 may be respectively coupled to the support structure 188, as shown.

The cleaning doctor loading cylinders 242, 244 may be operated via air pressure to selectively apply a loading force or an unloading force to the cleaning doctor 142. The CLBLCS 164 may include an electronic solenoid valve 252, a pair of electronic pressure controllers 256, 258, a pair of pressure indicators 262, 264, a pressure switch 268, and a plurality of air lines. The electronic solenoid valve 252 may be in communication with an air source 272 and configured to control air flow to and from the cleaning doctor loading cylinders 242, 244 via the air lines, as shown. In particular, the electronic solenoid valve 252 may be configured to control inlet air flow from the air source 272 to the cleaning doctor loading cylinders 242, 244 and exhaust air flow from the cleaning doctor loading cylinders 242, 244 to one or more exhaust lines. A first air line 276 may be disposed between the electronic solenoid valve 252 and a load side of the first cleaning doctor loading cylinder 242. In this manner, the first air line 276 may be configured to deliver inlet air to the load side of the loading cylinder 242 and to receive exhaust air from the load side of the loading cylinder 242.

The first electronic pressure controller 256 may be disposed along the first air line 276 and configured to control the pressure of the air delivered to the load side of the first cleaning doctor loading cylinder 242 (i.e., the loading pressure of the loading cylinder 242 on the cleaning doctor 142). The first pressure indicator 262 may be disposed along the first air line 276 downstream of the first electronic pressure controller 256 and configured to indicate (i.e., display) the actual pressure of the air delivered to the load side of the first cleaning doctor loading cylinder 242 (i.e., the actual loading pressure of the loading cylinder 242 on the cleaning doctor 142). The pressure switch 268 may be disposed along the first air line 276 downstream of the first pressure indicator 262 and configured to indicate that pressurized air is present in the first air line 276.

In a similar manner, a second air line 278 may be disposed between the electronic solenoid valve 252 and a load side of the second cleaning doctor loading cylinder 244. In this manner, the second air line 278 may be configured to deliver inlet air to the load side of the loading cylinder 244 and to receive exhaust air from the load side of the loading cylinder 244. The second electronic pressure controller 258 may be disposed along the second air line 278 and configured to control the pressure of the air delivered to the load side of the second cleaning doctor loading cylinder 244 (i.e., the loading pressure of the loading cylinder 244 on the cleaning doctor 142). The second pressure indicator 264 may be disposed along the second air line 278 downstream of the second electronic pressure controller 258 and configured to indicate the actual pressure of the air delivered to the load side of the second cleaning doctor loading cylinder 244 (i.e., the actual loading pressure of the loading cylinder 244 on the cleaning doctor 142). A third air line 282 may be disposed between the electronic solenoid valve 252 and an un-load side of the first cleaning doctor loading cylinder 242. In this manner, the third air line 282 may be configured to deliver inlet air to the un-load side of the loading cylinder 242 and to receive exhaust air from the un-load side of the loading cylinder 242. In a similar manner, a fourth air line 284 may be disposed between the electronic solenoid valve 252 and an un-load side of the second cleaning doctor loading cylinder 244. In this manner, the fourth air line 284 may be configured to deliver inlet air to the un-load side of the loading cylinder 244 and to receive exhaust air from the un-load side of the loading cylinder 244.

As shown, the electronic solenoid valve 252, the electronic pressure controllers 256, 258, and the pressure switch 268 may be in communication with a portion of the system controller 176 and configured to send respective signals to the system controller 176 and/or receive respective signals from the system controller 176 in accordance with the respective functions of the components. As described above, the system controller 176 may be in communication with the operator interface 178, which may include a hand switch 290, a pair of pressure indicators 292, 294, and a pair of hand indicating controllers 296, 298. The hand switch 290 may be configured to open and close the electronic solenoid valve 252, upon actuation of the hand switch 290 by an operator, to control the flows of inlet air from the air source 272 to the cleaning doctor loading cylinders 242, 244 and the flows of exhaust air from the cleaning doctor loading cylinders 242, 244 to one or more exhaust lines. The first pressure indicator 262 may be configured to indicate (i.e., display) the actual loading pressure of the first cleaning doctor loading cylinder 242 on the cleaning doctor 142, based upon a signal received by the system controller 176 from the first electronic pressure controller 256. The first hand indicating controller 296 may be configured to establish, adjust, and indicate a setpoint for the loading pressure of the first cleaning doctor loading cylinder 242 on the cleaning doctor 142. Upon actuation of the first hand indicating controller 296 by an operator to establish or adjust a setpoint, the system controller 176 may send a signal to the first electronic pressure controller 256 to maintain the setpoint. In a similar manner, the second pressure indicator 294 may be configured to indicate (i.e., display) the actual loading pressure of the second cleaning doctor loading cylinder 244 on the cleaning doctor 142, based upon a signal received by the system controller 176 from the second electronic pressure controller 258. The second hand indicating controller 298 may be configured to establish, adjust, and indicate a setpoint for the loading pressure of the second cleaning doctor loading cylinder 244 on the cleaning doctor 142. Upon actuation of the second hand indicating controller 298 by an operator to establish or adjust a setpoint, the system controller 176 may send a signal to the second electronic pressure controller 258 to maintain the setpoint. In some embodiments, the loading pressure setpoints for the first electronic pressure controller 256 and the second electronic pressure controller 258 may be the same (i.e., equal to one another). In other embodiments, the loading pressure setpoints for the first electronic pressure controller 256 and the second electronic pressure controller 258 may be different from one another, such that loading of the cleaning doctor 142 is biased toward the tend side or the drive side thereof.

During operation of the papermaking machine 100, the CLBLCS 164 may provide a high-speed closed-loop system for remotely controlling positioning and loading of the cleaning blade 144 against the coated outer surface of the Yankee dryer 120. In particular, the electronic pressure controllers 256, 258 may provide precise control of the loading pressures of the cleaning doctor loading cylinders 242, 244 on the cleaning doctor 142, based on setpoints that may be established and adjusted by an operator via the hand indicating controllers 296, 298. In this manner, the electronic pressure controllers 256, 258 may prevent drift of the loading pressures over time. The pressure indicators 292, 294 may provide accurate real-time readings of the actual loading pressures of the cleaning doctor loading cylinders 242, 244 on the cleaning doctor 142. The system controller 176 may include a memory that stores data relating to the loading pressure setpoints and the actual loading pressures of the loading cylinders 242, 244 during operation of the papermaking machine 100. In this manner, the system controller 176 may track changes in the loading pressure setpoints and the actual loading pressures over time, which may facilitate troubleshooting of certain performance problems, such as wear of the cleaning blade 144 or excessive buildup or uneven distribution of the coating 128. In particular, the operator interface 178 may be configured to graphically display the loading pressure setpoint data and the actual loading pressure data over time, such that an operator may review significant changes or trends and may determine any desired adjustments to the loading pressure setpoints. Ultimately, the CLBLCS 164 may be used to optimize the loading pressures of the cleaning doctor loading cylinders 242, 244 to the lowest values that maintain reliable operation of the cleaning blade 144 (which may be referred to as the "lowest reliable loading pressure"). Such optimization may ensure that the cleaning blade 144 provides an adequate base layer of the coating 128 for subsequent application of coating materials 148, and may decrease wear of the cleaning blade 144, thereby decreasing the frequency of blade change-outs, decreasing operating costs, and increasing operating efficiency. It will be understood that the loading pressures of the loading cylinders 242, 244 on the cleaning doctor 142 correlate to a blade pressure of the cleaning blade 144 on the outer surface of the Yankee dryer 120, and that conversion charts may be used to determine the blade pressure resulting from certain loading pressure setpoints.

Figure 5A:
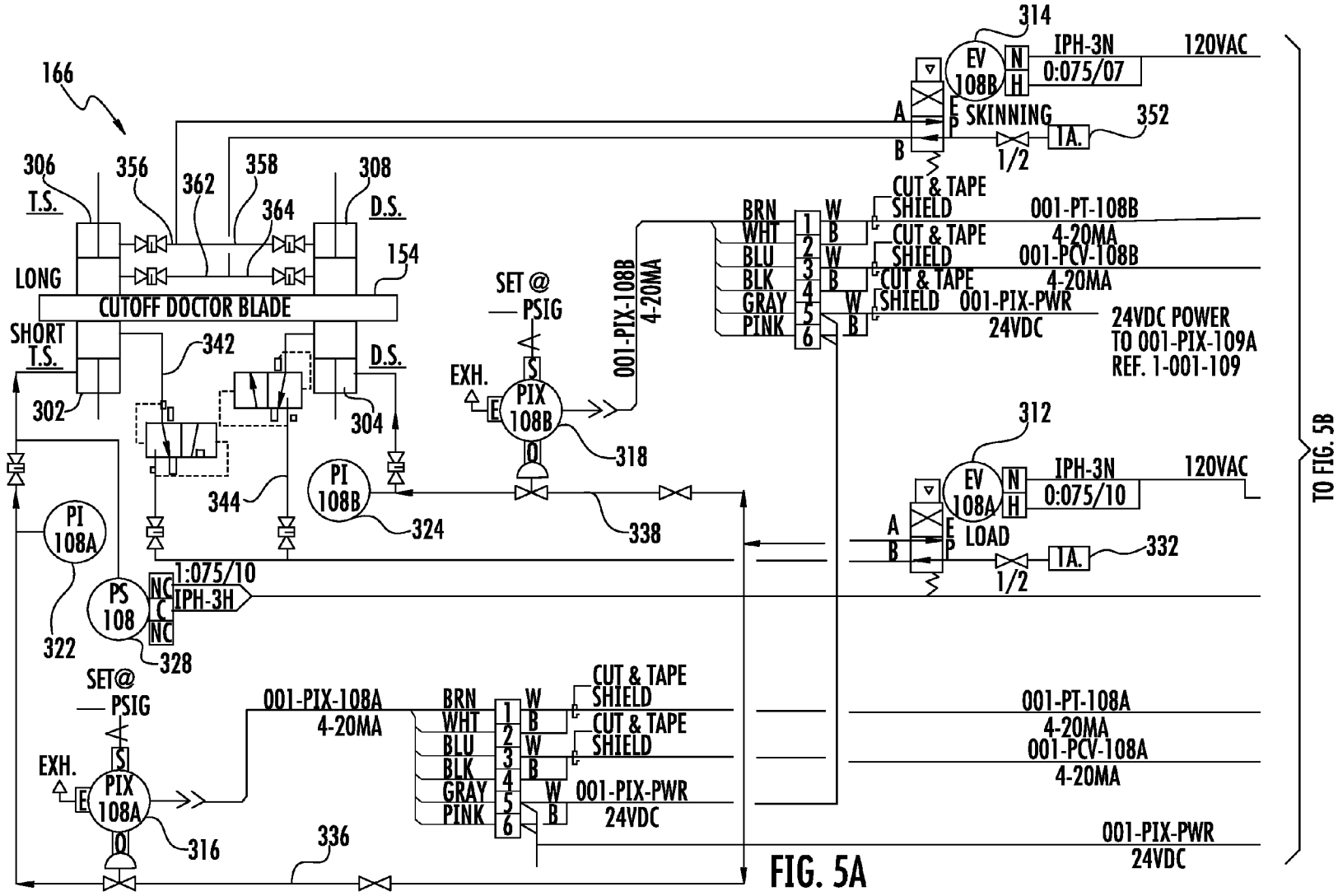
FIG. 5A is a schematic diagram of a portion of the papermaking machine of FIG. 1, including a portion of a loading control system for a cut-off doctor blade.
Figure 5B:
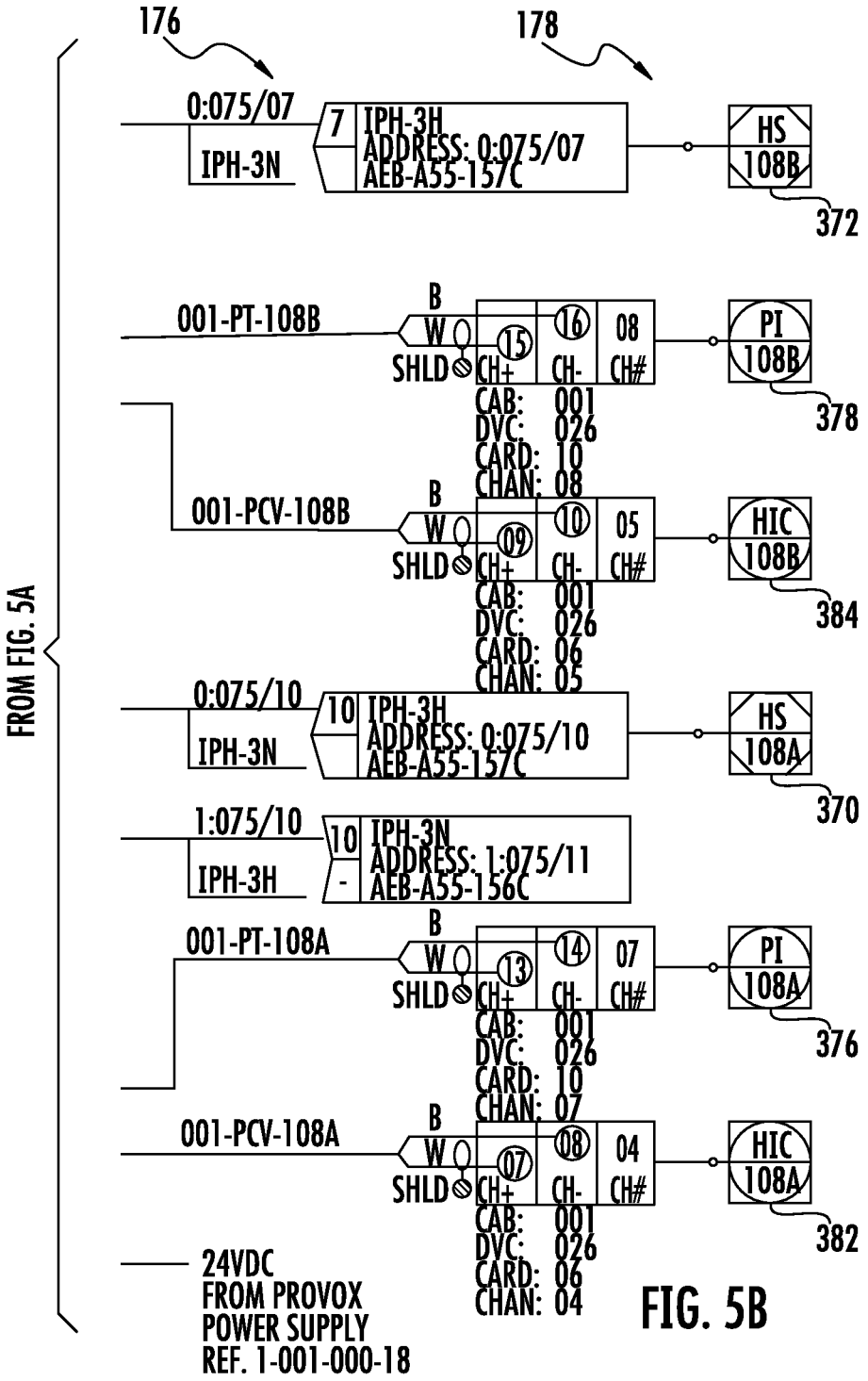
FIG. 5B is a schematic diagram of a portion of the papermaking machine of FIG. 1, including a portion of the loading control system for a cut-off doctor blade.

The cut-off blade loading control system (CUBLCS) 166, illustrated in detail in FIGS. 5A and 5B, and with reference to FIGS. 1 and 2, may be operable to control positioning and loading of the cut-off blade 154 against the coated outer surface of the Yankee dryer 120 and skinning of the dry fibrous web 110 from the Yankee dryer 120. The CUBLCS 166 may include a first pair of cut-off doctor loading cylinders 302, 304 coupled to the cut-off doctor 152 and configured to selectively apply a loading force or an unloading force to the cut-off doctor 152 such that the cut-off blade 154 is forced into engagement with or out of engagement with the coated outer surface of the Yankee dryer 120. In particular, the first cut-off doctor loading cylinder 302 (which also may be referred to as a "tend side cut-off doctor loading cylinder") may be coupled to the tend side of the cut-off doctor 152, and the second cut-off doctor loading cylinder 304 (which also may be referred to as a "drive side cut-off doctor loading cylinder") may be coupled to the drive side of the cut-off doctor 152. Each of the cut-off doctor loading cylinders 302, 304 may be respectively coupled to the cut-off doctor 152 via a control arm. Additionally, the cut-off doctor loading cylinders 302, 304 may be respectively coupled to the support structure 188.

The CUBLCS 166 also may include a second pair of cut-off doctor loading cylinders 306, 308 coupled to the cut-off doctor 152 and configured to selectively apply a loading force or an unloading force to the cut-off doctor 152 such that the cut-off blade 154 skins the dry fibrous web 110 from the outer surface of the Yankee dryer 120 and redirects the web 110 as desired, such as to a pulper. In particular, the third cut-off doctor loading cylinder 306 (which also may be referred to as a "tend side cut-off doctor loading cylinder") may be coupled to the tend side of the cut-off doctor 152, and the fourth cut-off doctor loading cylinder 308 (which also may be referred to as a "drive side cut-off doctor loading cylinder") may be coupled to the drive side of the cut-off doctor 152. Each of the cut-off doctor loading cylinders 306, 308 may be respectively coupled to the cut-off doctor 152 via a control arm. Additionally, the cut-off doctor loading cylinders 306, 308 may be respectively coupled to the support structure 188.

The cut-off doctor loading cylinders 302, 304, 306, 308 may be operated via air pressure to selectively apply a loading force or an unloading force to the cut-off doctor 152. The CUBLCS 166 may include a pair of electronic solenoid valves 312, 314, a pair of electronic pressure controllers 316, 318, a pair of pressure indicators 322, 324, a pressure switch 328, and a plurality of air lines. The first electronic solenoid valve 312 may be in communication with a first air source 332 and configured to control air flow to and from the first and second cut-off doctor loading cylinders 302, 304 via the air lines, as shown. In particular, the first electronic solenoid valve 312 may be configured to control inlet air flow from the first air source 332 to the first and second cut-off doctor loading cylinders 302, 304 and exhaust air flow from the first and second cut-off doctor loading cylinders 302, 304 to one or more exhaust lines. A first air line 336 may be disposed between the first electronic solenoid valve 312 and a load side of the first cut-off doctor loading cylinder 302. In this manner, the first air line 336 may be configured to deliver inlet air to the load side of the loading cylinder 302 and to receive exhaust air from the load side of the loading cylinder 302. The first electronic pressure controller 316 may be disposed along the first air line 336 and configured to control the pressure of the air delivered to the load side of the first cut-off doctor loading cylinder 302 (i.e., the loading pressure of the loading cylinder 302 on the cut-off doctor 152). The first pressure indicator 322 may be disposed along the first air line 336 downstream of the first electronic pressure controller 316 and configured to indicate (i.e., display) the actual pressure of the air delivered to the load side of the first cut-off doctor loading cylinder 302 (i.e., the actual loading pressure of the loading cylinder 302 on the cut-off doctor 152). The pressure switch 328 may be disposed along the first air line 336 downstream of the first pressure indicator 322 and configured to indicate that pressurized air is present in the first air line 336.

In a similar manner, a second air line 338 may be disposed between the first electronic solenoid valve 312 and a load side of the second cut-off doctor loading cylinder 304. In this manner, the second air line 338 may be configured to deliver inlet air to the load side of the loading cylinder 304 and to receive exhaust air from the load side of the loading cylinder 304. The second electronic pressure controller 318 may be disposed along the second air line 338 and configured to control the pressure of the air delivered to the load side of the second cut-off doctor loading cylinder 304 (i.e., the loading pressure of the loading cylinder 304 on the cut-off doctor 152). The second pressure indicator 324 may be disposed along the second air line 338 downstream of the second electronic pressure controller 318 and configured to indicate the actual pressure of the air delivered to the load side of the second cut-off doctor loading cylinder 304 (i.e., the actual loading pressure of the loading cylinder 304 on the cut-off doctor 152). A third air line 342 may be disposed between the first electronic solenoid valve 312 and an un-load side of the first cut-off doctor loading cylinder 302. In this manner, the third air line 342 may be configured to deliver inlet air to the un-load side of the loading cylinder 302 and to receive exhaust air from the un-load side of the loading cylinder 302. In a similar manner, a fourth air line 344 may be disposed between the first electronic solenoid valve 312 and an un-load side of the second cut-off doctor loading cylinder 304. In this manner, the fourth air line 344 may be configured to deliver inlet air to the un-load side of the loading cylinder 304 and to receive exhaust air from the un-load side of the loading cylinder 304.

The second electronic solenoid valve 314 may be in communication with a second air source 352 and configured to control air flow to and from the third and fourth cut-off doctor loading cylinders 306, 308 via the air lines, as shown. In particular, the second electronic solenoid valve 314 may be configured to control inlet air flow from the air source 352 to the third and fourth cut-off doctor loading cylinders 306, 308 and exhaust air flow from the third and fourth cut-off doctor loading cylinders 306, 308 to one or more exhaust lines. A fifth air line 356 may be disposed between the second electronic solenoid valve 314 and a load side of the third cut-off doctor loading cylinder 306. In this manner, the fifth air line 356 may be configured to deliver inlet air to the load side of the loading cylinder 306 and to receive exhaust air from the load side of the loading cylinder 306. In a similar manner, a sixth air line 358 may be disposed between the second electronic solenoid valve 314 and a load side of the fourth cut-off doctor loading cylinder 308. In this manner, the sixth air line 358 may be configured to deliver inlet air to the load side of the loading cylinder 308 and to receive exhaust air from the load side of the loading cylinder 308. A seventh air line 362 may be disposed between the second electronic solenoid valve 314 and an un-load side of the third cut-off doctor loading cylinder 306. In this manner, the seventh air line 362 may be configured to deliver inlet air to the un-load side of the loading cylinder 306 and to receive exhaust air from the un-load side of the loading cylinder 306. In a similar manner, an eighth air line 364 may be disposed between the second electronic solenoid valve 314 and an un-load side of the fourth cut-off doctor loading cylinder 308. In this manner, the eighth air line 364 may be configured to deliver inlet air to the un-load side of the loading cylinder 308 and to receive exhaust air from the un-load side of the loading cylinder 308.

As shown, the electronic solenoid valves 312, 314, the electronic pressure controllers 316, 318, and the pressure switch 328 may be in communication with a portion of the system controller 176 and configured to send respective signals to the system controller 176 and/or receive respective signals from the system controller 176 in accordance with the respective functions of the components. As described above, the system controller 176 may be in communication with the operator interface 178, which may include a pair of hand switches 370, 372, a pair of pressure indicators 376, 378, and a pair of hand indicating controllers 382, 384. The first hand switch 370 may be configured to open and close the first electronic solenoid valve 312, upon actuation of the first hand switch 370 by an operator, to control the flows of inlet air from the first air source 332 to the first and second cut-off doctor loading cylinders 302, 304 and the flows of exhaust air from the first and second cut-off doctor loading cylinders 302, 304 to one or more exhaust lines. The second hand switch 372 may be configured to open and close the second electronic solenoid valve 314, upon actuation of the second hand switch 372 by an operator, to control the flows of inlet air from the second air source 352 to the third and fourth cut-off doctor loading cylinders 306, 308 and the flows of exhaust air from the third and fourth cut-off doctor loading cylinders 306, 308 to one or more exhaust lines.

The first pressure indicator 376 may be configured to indicate (i.e., display) the actual loading pressure of the first cut-off doctor loading cylinder 302 on the cut-off doctor 152, based upon a signal received by the system controller 176 from the first electronic pressure controller 316. The first hand indicating controller 382 may be configured to establish, adjust, and indicate a setpoint for the loading pressure of the first cut-off doctor loading cylinder 302 on the cut-off doctor 152. Upon actuation of the first hand indicating controller 382 by an operator to establish or adjust a setpoint, the system controller 176 may send a signal to the first electronic pressure controller 316 to maintain the setpoint. In a similar manner, the second pressure indicator 378 may be configured to indicate (i.e., display) the actual loading pressure of the second cut-off doctor loading cylinder 304 on the cut-off doctor 152, based upon a signal received by the system controller 176 from the second electronic pressure controller 318. The second hand indicating controller 384 may be configured to establish, adjust, and indicate a setpoint for the loading pressure of the second cut-off doctor loading cylinder 304 on the cut-off doctor 152. Upon actuation of the second hand indicating controller 384 by an operator to establish or adjust a setpoint, the system controller 176 may send a signal to the second electronic pressure controller 318 to maintain the setpoint.

During operation of the papermaking machine 100, the CUBLCS 166 may provide a high-speed closed-loop system for remotely controlling positioning and loading of the cut-off blade 154 against the coated outer surface of the Yankee dryer 120. In particular, the electronic pressure controllers 316, 318 may provide precise control of the loading pressures of the first and second cut-off doctor loading cylinders 302, 304 on the cut-off doctor 152, based on setpoints that may be established and adjusted by an operator via the hand indicating controllers 382, 384. In this manner, the electronic pressure controllers 316, 318 may prevent drift of the loading pressures over time. The pressure indicators 376, 378 may provide accurate real-time readings of the actual loading pressures of the first and second cut-off doctor loading cylinders 302, 304 on the cut-off doctor 152. The system controller 176 may include a memory that stores data relating to the loading pressure setpoints and the actual loading pressures of the loading cylinders 302, 304 during operation of the papermaking machine 100. In this manner, the system controller 176 may track changes in the loading pressure setpoints and the actual loading pressures over time, which may facilitate troubleshooting of certain performance problems, such as wear of the cut-off blade 154 or operation of the cut-off process. In particular, the operator interface 178 may be configured to graphically display the loading pressure setpoint data and the actual loading pressure data over time, such that an operator may review significant changes or trends and may determine any desired adjustments to the loading pressure setpoints. Ultimately, the CUBLCS 166 may be used to optimize the loading pressures of the first and second cut-off doctor loading cylinders 302, 304 to the lowest values that maintain reliable operation of the cut-off blade 154 (which may be referred to as the "lowest reliable loading pressure"). Such optimization may decrease wear of the cut-off blade 154, thereby decreasing the frequency of blade change-outs, decreasing operating costs, and increasing operating efficiency. It will be understood that the loading pressures of the loading cylinders 302, 304 on the cut-off doctor 152 correlate to a blade pressure of the cut-off blade 154 on the outer surface of the Yankee dryer 120, and that conversion charts may be used to determine the blade pressure resulting from certain loading pressure setpoints.

Figure 6:
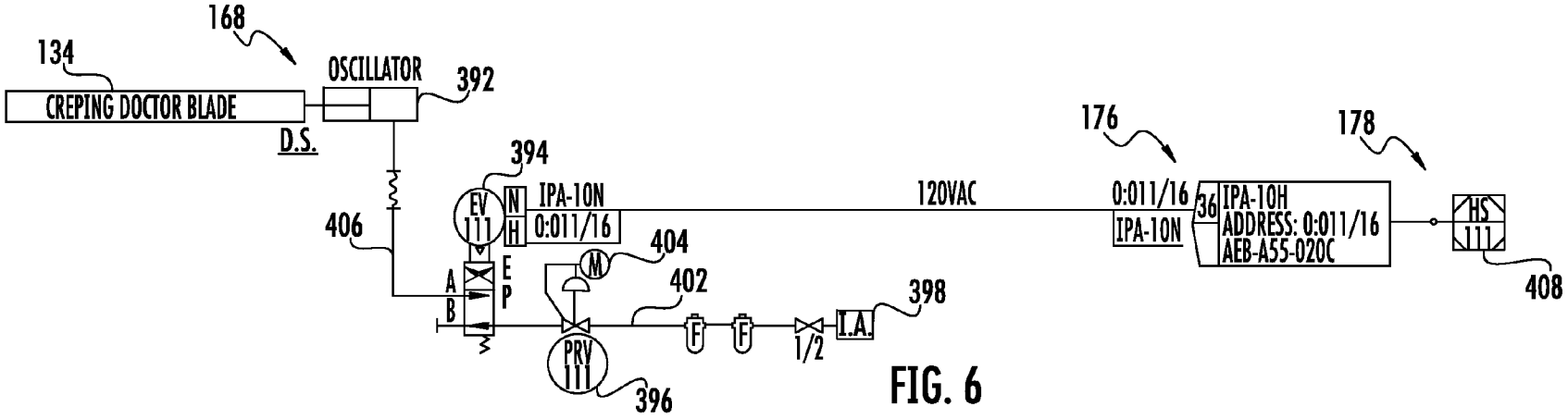
FIG. 6 is a schematic diagram of a portion of the papermaking machine of FIG. 1, including an oscillating control system for a creping doctor blade.

The creping blade oscillating control system (CRBOCS) 168, illustrated in detail in FIG. 6, and with reference to FIG. 1, may be operable to control oscillation of the creping blade 134 along the coated outer surface of the Yankee dryer 120. The CRBOCS 168 may include a creping doctor oscillator 392, an electronic solenoid valve 394, a pressure regulator 396, and a plurality of air lines. The creping doctor oscillator 392 may be coupled to the drive side of the creping doctor 132 and configured to selectively oscillate the creping doctor 132 back and forth in the direction of the longitudinal axis of the creping doctor 132. In this manner, the creping blade 134 may oscillate along the coated outer surface of the Yankee dryer 120 to inhibit uneven distribution of the coating 128. The creping doctor oscillator 392 may be operated via air pressure to selectively oscillate the creping doctor 132.

The electronic solenoid valve 394 may be in communication with an air source 398 and configured to control air flow to and from the creping doctor oscillator 392. In particular, the electronic solenoid valve 394 may be configured to control inlet air flow from the air source 398 to the creping doctor oscillator 392 and exhaust air flow from the creping doctor oscillator 392. A first air line 402 may be disposed between the air source 398 and the electronic solenoid valve 394 and configured to deliver a supply of air to the electronic solenoid valve 394. The pressure regulator 396 may be disposed along the first air line 402 and configured to control the pressure of the air delivered to the electronic solenoid valve 394. As shown, the pressure regulator 396 may include a pressure indicator 404 configured to indicate (i.e., display) the actual pressure of the air delivered to the electronic solenoid valve 394. A second air line 406 may be disposed between the electronic solenoid valve 394 and the creping doctor oscillator 392 and configured to deliver inlet air to the creping doctor oscillator 392 and to receive exhaust air from the creping doctor oscillator 392. As shown, the electronic solenoid valve 394 may be in communication with a portion of the system controller 176 and configured to send signals to the system controller 176 and receive respective signals from the system controller 176. As described above, the system controller 176 may be in communication with the operator interface 178, which may include a hand switch 408. The hand switch 408 may be configured to open and close the electronic solenoid valve 394, upon actuation of the hand switch 408 by an operator, to control the flow of inlet air to the creping doctor oscillator 392 and the flow of exhaust air from the creping doctor oscillator 392.

Figure 7:
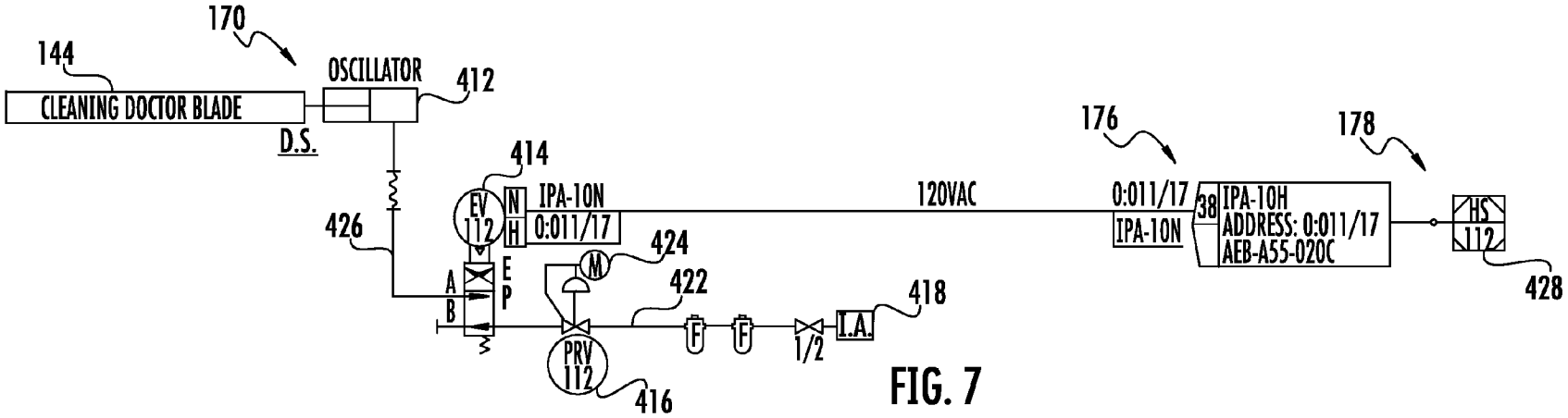
FIG. 7 is a schematic diagram of a portion of the papermaking machine of FIG. 1, including an oscillating control system for a cleaning doctor blade.

The cleaning blade oscillating control system (CLBOCS) 170, illustrated in detail in FIG. 7, and with reference to FIG. 1, may be operable to control oscillation of the cleaning blade 144 along the coated outer surface of the Yankee dryer 120. The CLBOCS 170 may include a cleaning doctor oscillator 412, an electronic solenoid valve 414, a pressure regulator 416, and a plurality of air lines. The cleaning doctor oscillator 412 may be coupled to the drive side of the cleaning doctor 142 and configured to selectively oscillate the cleaning doctor 142 back and forth in the direction of the longitudinal axis of the cleaning doctor 142. In this manner, the cleaning blade 144 may oscillate along the coated outer surface of the Yankee dryer 120 to inhibit uneven distribution of the coating 128. The cleaning doctor oscillator 412 may be operated via air pressure to selectively oscillate the cleaning doctor 142.

The electronic solenoid valve 414 may be in communication with an air source 418 and configured to control air flow to and from the cleaning doctor oscillator 412. In particular, the electronic solenoid valve 414 may be configured to control inlet air flow from the air source 418 to the cleaning doctor oscillator 412 and exhaust air flow from the cleaning doctor oscillator 412. A first air line 422 may be disposed between the air source 418 and the electronic solenoid valve 414 and configured to deliver a supply of air to the electronic solenoid valve 414. The pressure regulator 416 may be disposed along the first air line 422 and configured to control the pressure of the air delivered to the electronic solenoid valve 414. As shown, the pressure regulator 416 may include a pressure indicator 424 configured to indicate (i.e., display) the actual pressure of the air delivered to the electronic solenoid valve 414. A second air line 426 may be disposed between the electronic solenoid valve 414 and the cleaning doctor oscillator 412 and configured to deliver inlet air to the cleaning doctor oscillator 412 and to receive exhaust air from the cleaning doctor oscillator 412. As shown, the electronic solenoid valve 414 may be in communication with a portion of the system controller 176 and configured to send signals to the system controller 176 and receive respective signals from the system controller 176. As described above, the system controller 176 may be in communication with the operator interface 178, which may include a hand switch 428. The hand switch 428 may be configured to open and close the electronic solenoid valve 414, upon actuation of the hand switch 428 by an operator, to control the flow of inlet air to the cleaning doctor oscillator 412 and the flow of exhaust air from the cleaning doctor oscillator 412.

Figure 8A:
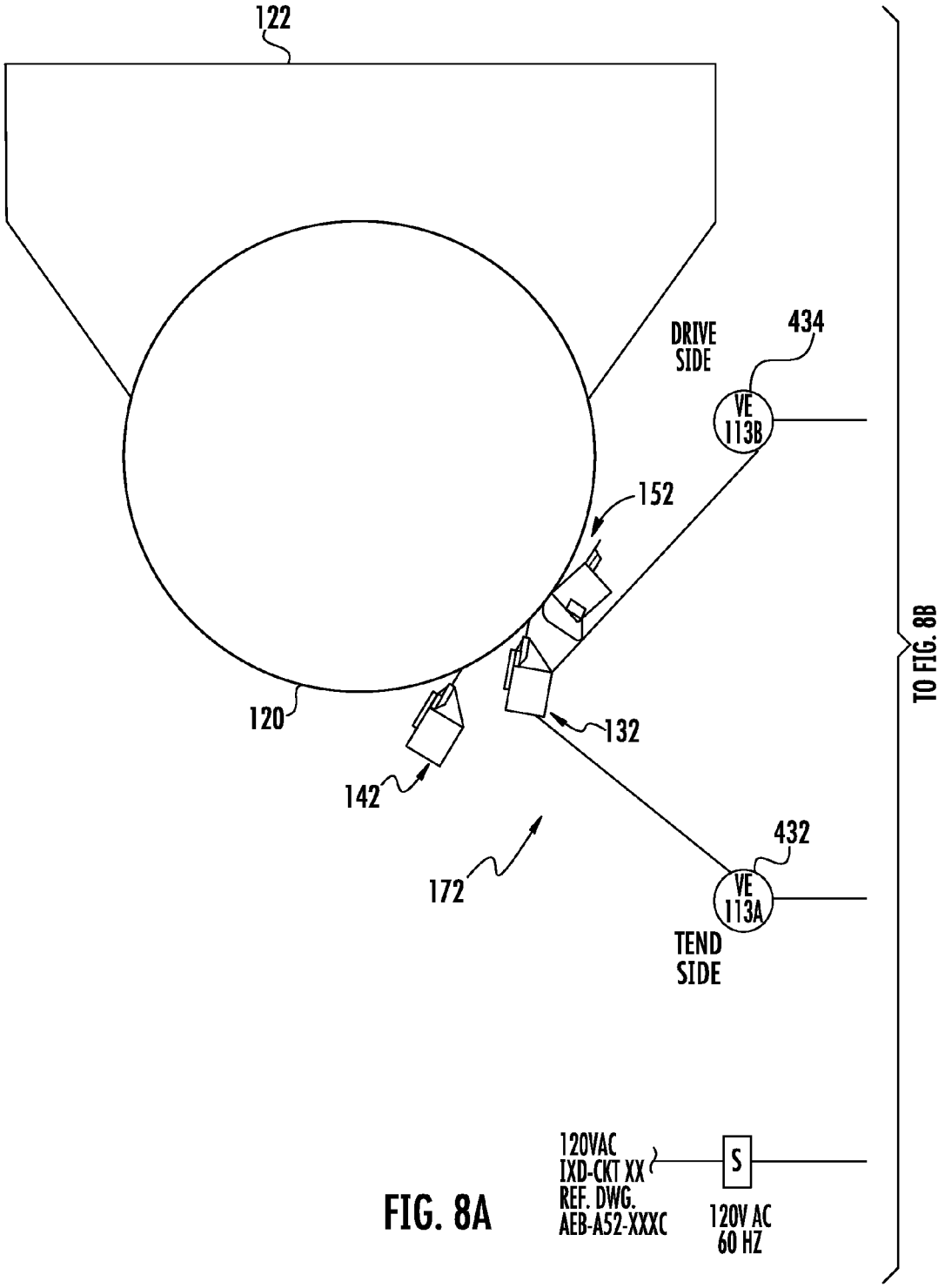
FIG. 8A is a schematic diagram of a portion of the papermaking machine of FIG. 1, including a portion of a vibration monitoring system for a creping doctor blade.
Figure 8B:
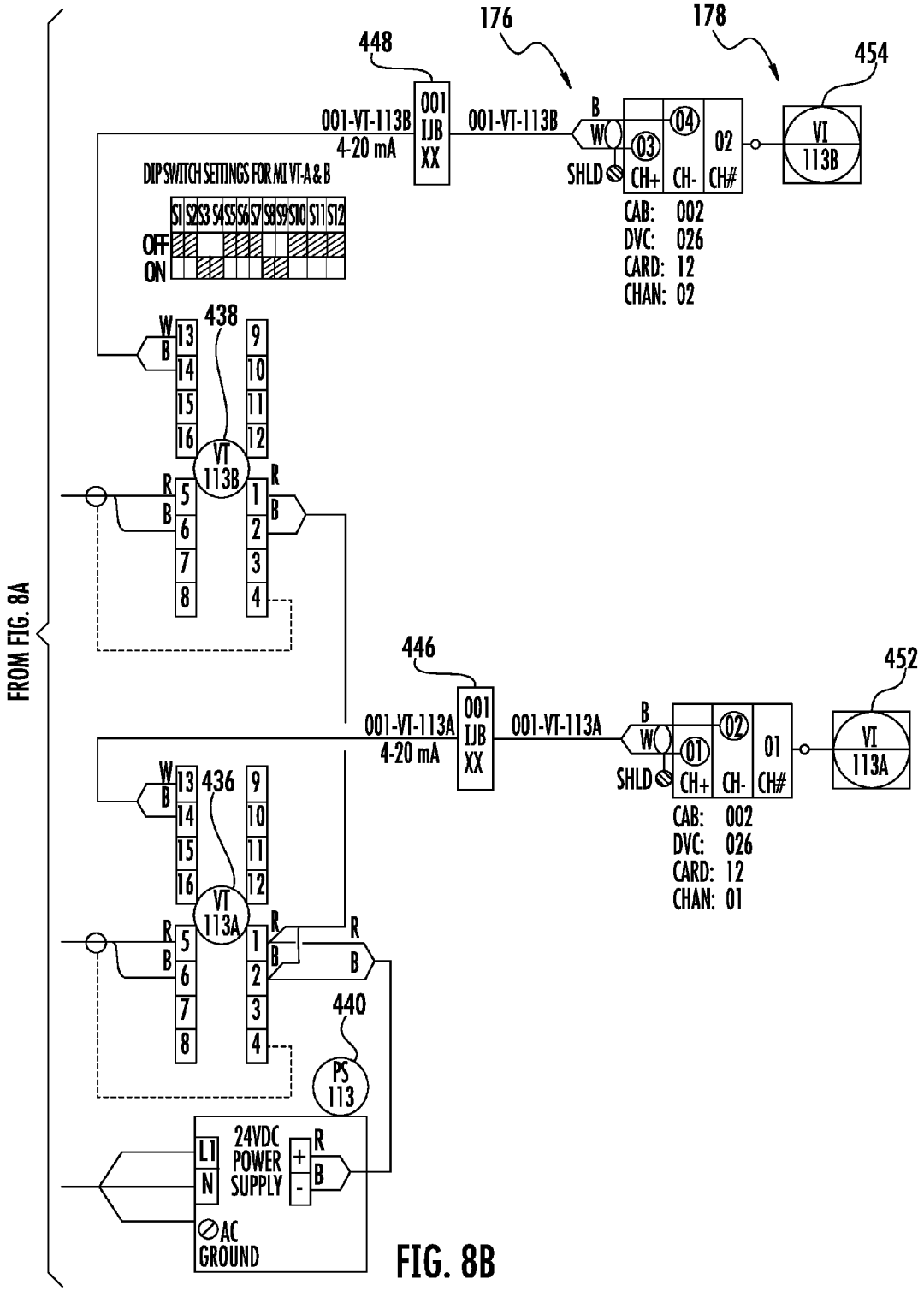
FIG. 8B is a schematic diagram of a portion of the papermaking machine of FIG. 1, including a portion of the vibration monitoring system for a creping doctor blade.

The creping blade vibration monitoring system (CRBVMS) 172, illustrated in detail in FIGS. 8A and 8B, and with reference to FIG. 1, may be operable to monitor vibration of the creping blade 134 against the coated outer surface of the Yankee dryer 120. The CRBVMS 172 may include a pair of accelerometers 432, 434, a pair of vibration transmitters 436, 438, and a power supply 440. The first accelerometer 432 may be mounted to the tend side of the creping doctor 132 and configured to measure or detect vibration of the tend side of the creping blade 134 and to generate and send a first vibration signal. The second accelerometer 434 may be mounted to the drive side of the creping doctor 132 and configured to measure or detect vibration of the drive side of the creping blade 134 and to generate and send a second vibration signal. In some embodiments, the accelerometers 432, 434 may be mounted directly to the respective sides of the creping blade holder 136, as shown in FIG. 2. In other embodiments, the accelerometers 432, 434 may be mounted to other portions of the creping doctor 132, such as the creping blade 134.

As shown, the first vibration transmitter 436 may be in communication with the first accelerometer 432 and configured to receive the first vibration signal therefrom. In a similar manner, the second vibration transmitter 438 may be in communication with the second accelerometer 434 and configured to receive the second vibration signal therefrom. The vibration transmitters 436, 438 may be in communication with the power supply 440 and configured to receive power therefrom. As shown, the vibration transmitters 436, 438 may be in communication with a portion of the system controller 176, such as via a pair of instrument junction boxes 446, 448, and configured to send the respective vibration signals to the system controller 176. As described above, the system controller 176 may be in communication with the operator interface 178, which may include a pair of vibration indicators 452, 454. The first vibration indicator 452 may be configured to indicate (i.e., display) the vibration of the tend side of the creping blade 134, based upon the first vibration signal received by the system controller 176 from the first vibration transmitter 436. In a similar manner, the second vibration indicator 454 may be configured to indicate (i.e., display) the vibration of the drive side of the creping blade 134, based upon the second vibration signal received by the system controller 176 from the second vibration transmitter 438.

During operation of the papermaking machine 100, the CRBVMS 172 may provide a system for remotely monitoring vibration of the creping blade 134 against the coated outer surface of the Yankee dryer 120. In particular, the CRBVMS 172 may continuously measure vibration of the creping blade 134 via the accelerometers 432, 434 and send the respective vibration signals via the vibration transmitters 436, 438 to the system controller 176, which receives the vibration signals and causes the vibration indicators 452, 454 to display vibration values for operator use. The system controller 176 may include a memory that stores data relating to the vibration of the creping blade 134 during operation of the papermaking machine 100. In this manner, the system controller 176 may track changes in the vibration values over time, which may facilitate troubleshooting of "chatter" of the creping blade 134. In particular, the operator interface 178 may be configured to graphically display the vibration data over time, such that an operator may review significant changes and determine any desired adjustments to address undesirable vibration values. For example, when vibration of the tend side and/or the drive side of the creping blade 134 is outside of a predetermined range, an operator may adjust (i.e., decrease or increase) one or both of the setpoints for the loading pressures of the creping doctor loading cylinders 182, 184 (FIG. 3A) until the vibration of the creping blade 134 is within the predetermined range, which may ensure adequate creping of the fibrous web 110 and inhibit damage to the coating 128, the outer surface of the Yankee dryer 120, and the creping blade 134. In this manner, the CRBVMS 172 may facilitate optimization of the loading pressures of the creping doctor loading cylinders 182, 184 to their lowest reliable loading pressures via the CRBLCS 162, as described above. Such optimization may decrease wear of the creping blade 134, thereby decreasing the frequency of blade change-outs, decreasing operating costs, and increasing operating efficiency.

In some embodiments, the system controller 176 may be configured to automatically direct the CRBLCS 162 to adjust the setpoints for the loading pressures of the creping doctor loading cylinders 182, 184, based on vibration of the creping blade 134 measured via the CRBVMS 172. In particular, when the system controller 176 receives the respective vibration signals from the vibration transmitters 436, 438 indicating that vibration of the tend side and/or the drive side of the creping blade 134 is outside of a predetermined range, the system controller 176 may send a signal to the CRBLCS 162 to adjust (i.e., decrease or increase) one or both of the loading pressure setpoints maintained by the electronic pressure controllers 196, 198 until vibration of the creping blade 134 is within the predetermined range. In this manner, the system controller 176 may automatically adjust the loading pressure setpoints, without operator intervention, to address undesired vibration of the creping blade 134.

Figure 9:
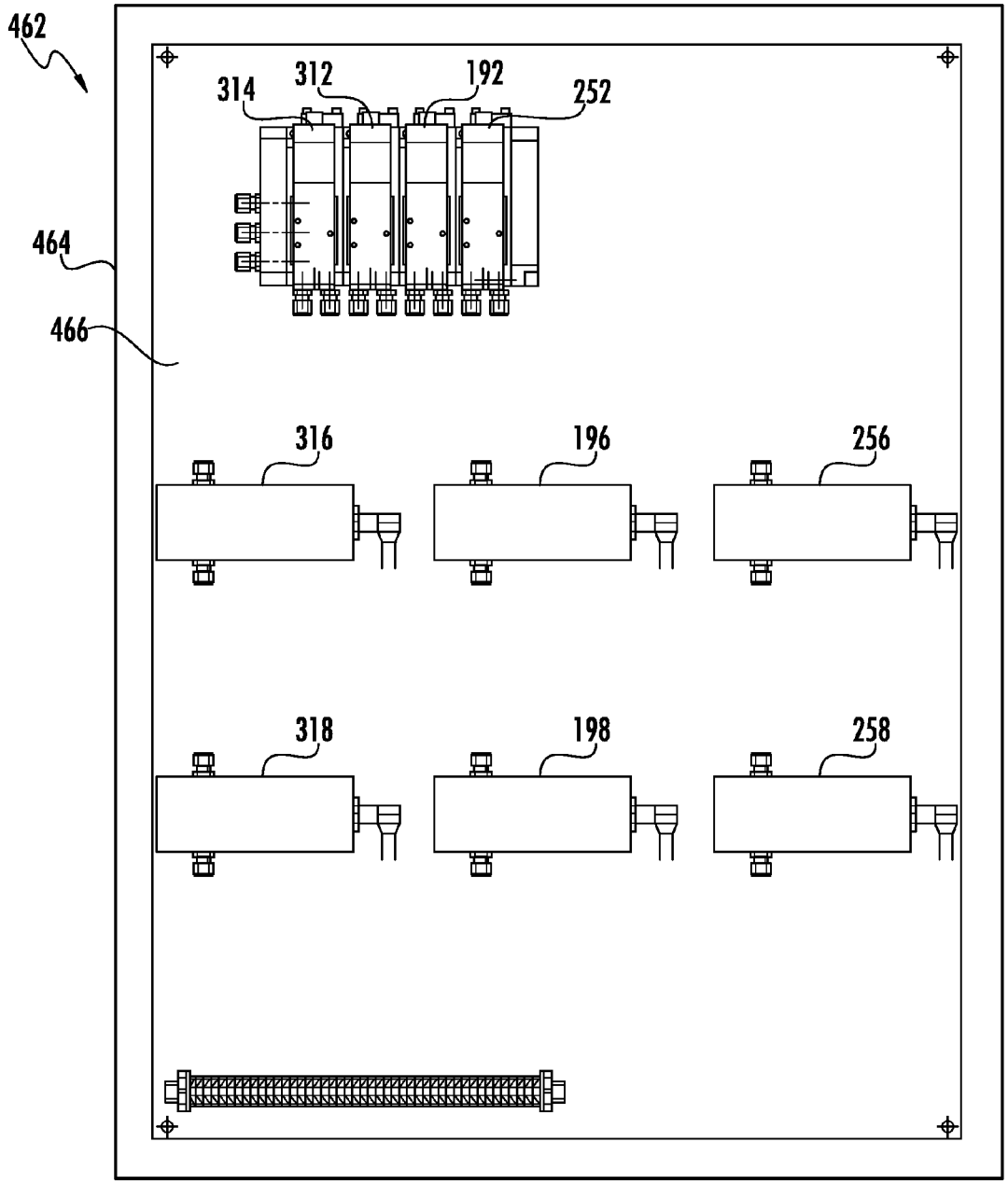
FIG. 9 is a front view of a doctor loading control panel of the papermaking machine of FIG. 1, including electronic solenoid valves and electronic pressure controllers of the loading control systems for the creping doctor blade, the cleaning doctor blade, and the cut-off doctor blade.

FIG. 9 illustrates a doctor loading control panel 462 configured for housing portions of the CRBLCS 162, the CLBLCS 164, and the CUBLCS 166. The loading panel 462 may include a main enclosure 464 and a sub-panel 466 contained within the main enclosure 464. Various components may be mounted to the sub-panel 466, including the electronic solenoid valve 192 and the electronic pressure controllers 196, 198 of the CRBLCS 162, the electronic solenoid valve 252 and the electronic pressure controllers 256, 258 of the CLBLCS 164, and the electronic solenoid valves 312, 314 and the electronic pressure controllers 316, 318 of the CUBLCS 166, as shown. The various electronic solenoid valves and electronic pressure controllers may be in communication with one another as described above.

Figure 10:
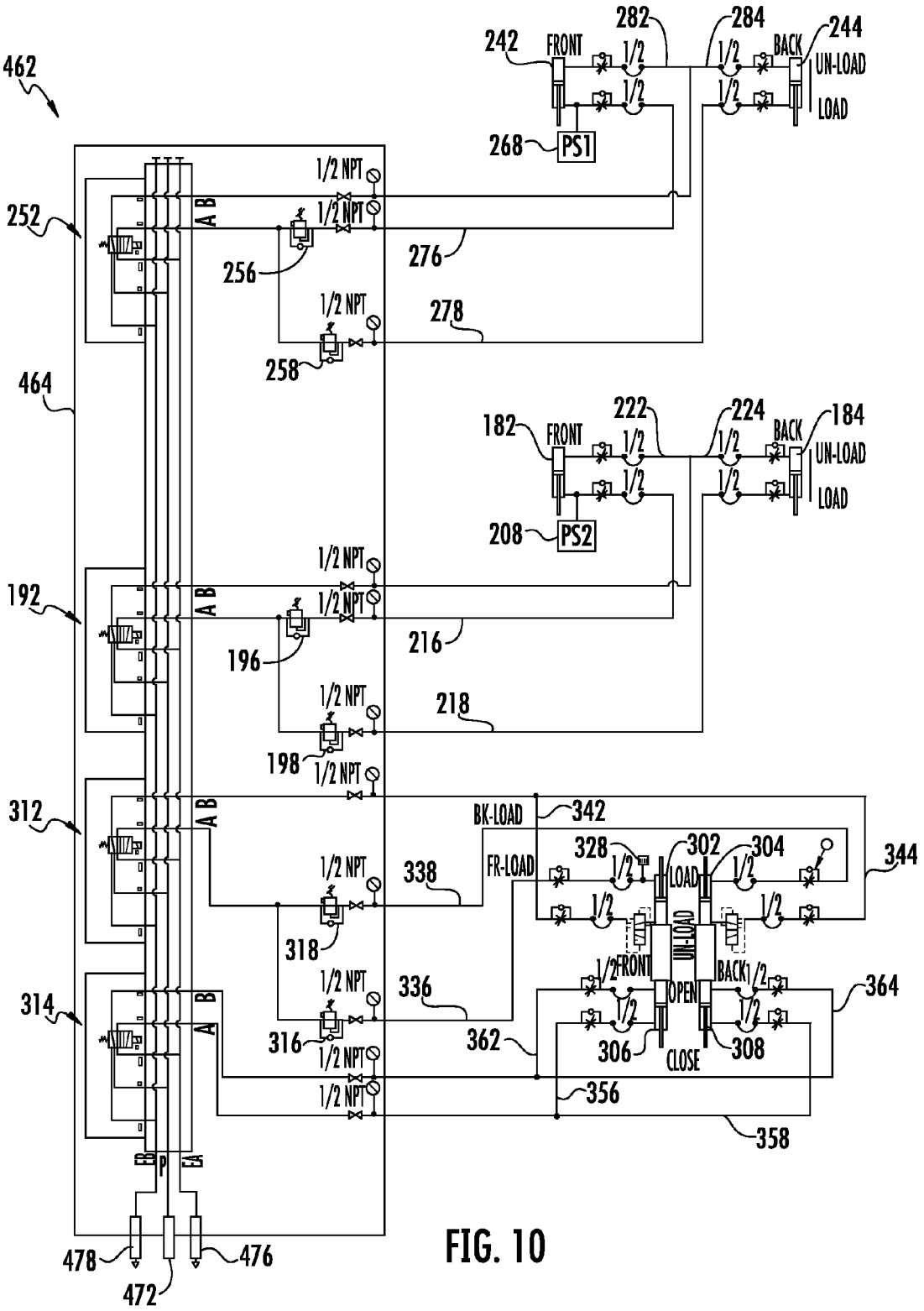
FIG. 10 is a schematic diagram of a portion of the papermaking machine of FIG. 1, including pneumatic connections between portions of the loading control systems for the creping doctor blade, the cleaning doctor blade, and the cut-off doctor blade.

FIG. 10, with reference to FIGS. 3A, 3B, 4A, 4B, 5A, and 5B, illustrates pneumatic connections between portions of the CRBLCS 162, the CLBLCS 164, and the CUBLCS 166. As shown, the electronic solenoid valve 192 of the CRBLCS 162, the electronic solenoid valve 252 of the CLBLCS 164, and the electronic solenoid valves 312, 314 of the CUBLCS 166 may be arranged in series and in communication with a common inlet air line 472 configured to direct a supply of air thereto. In this manner, the air sources 212, 272, 332, 352 described above may be the same air source. The electronic solenoid valves 192, 252, 312, 314 also may be in communication with a pair of exhaust air lines 476, 478 configured to receive exhaust air therefrom. In particular, the first exhaust air line 476 may be in communication with the electronic solenoid valves 192, 252, 312, 314 and configured to receive exhaust air received from the load sides of the doctor loading cylinders 182, 184, 242, 244, 302, 304, 306, 308 via the respective air lines. In a similar manner, the second exhaust air line 478 may be in communication with the electronic solenoid valves 192, 252, 312, 314 and configured to receive exhaust air received from the un-load sides of the doctor loading cylinders 182, 184, 242, 244, 302, 304, 306, 308 via the respective air lines.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific papermaking machine configurations, it will be appreciated that numerous other papermaking machine configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A papermaking machine for manufacturing a paper product, the papermaking machine comprising:

a Yankee dryer configured to rotate about an axis thereof;

a doctor positioned about the Yankee dryer, the doctor comprising a doctor blade supported by a doctor blade holder; and a doctor blade loading control system in communication with the doctor, the doctor blade loading control system comprising:

a first doctor loading cylinder coupled to a tend side of the doctor and configured to selectively apply a loading force to the doctor;

a second doctor loading cylinder coupled to a drive side of the doctor and configured to selectively apply a loading force to the doctor;

a first air line in communication with a load side of the first doctor loading cylinder and configured to deliver air thereto;

a second air line in communication with a load side of the second doctor loading cylinder and configured to deliver air thereto;

a first electronic pressure controller disposed along the first air line and configured to control a loading pressure of the first doctor loading cylinder on the doctor based on a first loading pressure setpoint, wherein the first electronic pressure controller is configured to control a first pressure of the air delivered to the load side of the first doctor loading cylinder; and a second electronic pressure controller disposed along the second air line and configured to control a loading pressure of the second doctor loading cylinder on the doctor based on a second loading pressure setpoint, wherein the second electronic pressure controller is configured to control a second pressure of the air delivered to the load side of the second doctor loading cylinder.

2. The papermaking machine of claim 1, further comprising:

a system controller in communication with the first electronic pressure controller and the second electronic pressure controller; and a user interface in communication with the system controller.

3. The papermaking machine of claim 2, wherein the user interface comprises:

a first hand indicating controller configured to adjust and indicate the first loading pressure setpoint; and a second hand indicating controller configured to adjust and indicate the second loading pressure setpoint.

4. The papermaking machine of claim 3, wherein the user interface further comprises:

a first pressure indicator configured to indicate the loading pressure of the first doctor loading cylinder on the doctor; and a second pressure indicator configured to indicate the loading pressure of the second doctor loading cylinder on the doctor.

5. The papermaking machine of claim 2, wherein the doctor blade loading control system further comprises an electronic solenoid valve in communication with the first air line and the second air line and configured to control air flow thereto, and wherein the electronic solenoid valve is positioned upstream of the first electronic pressure controller and the second electronic pressure controller.

6. The papermaking machine of claim 5, wherein the electronic solenoid valve is in communication with the system controller, and wherein the user interface comprises a hand switch configured to open and close the electronic solenoid valve.

7. The papermaking machine of claim 2, further comprising a doctor blade vibration monitoring system in communication with the doctor, the doctor blade vibration monitoring system comprising:

an accelerometer mounted to the doctor and configured to measure or detect vibration of the doctor blade and to generate and send a vibration signal; and a vibration transmitter in communication with the accelerometer and configured to receive the vibration signal therefrom.

8. The papermaking machine of claim 7, wherein the vibration transmitter is in communication with the system controller and configured to send the vibration signal thereto, and wherein the user interface comprises a vibration indicator configured to indicate the vibration of the doctor blade.

9. The papermaking machine of claim 7, wherein the vibration transmitter is in communication with the system controller and configured to send the vibration signal thereto, and wherein the system controller is configured to automatically adjust the first loading pressure setpoint and the second loading pressure setpoint based on the vibration of the doctor blade.

10. The papermaking machine of claim 1, wherein the doctor is a creping doctor, and wherein the doctor blade is a creping doctor blade configured to remove a fibrous web from the Yankee dryer and to crepe the fibrous web.

11. The papermaking machine of claim 1, wherein the doctor is a cleaning doctor, and wherein the doctor blade is a cleaning doctor blade configured to remove a portion of a coating from the Yankee dryer.

12. The papermaking machine of claim 1, wherein the doctor is a cut-off doctor, and wherein the doctor blade is a cut-off doctor blade configured to remove a fibrous web from the Yankee dryer and redirect the fibrous web.

13. A papermaking machine for manufacturing a paper product, the papermaking machine comprising:

a Yankee dryer configured to rotate about an axis thereof;

a doctor positioned about the Yankee dryer, the doctor comprising a doctor blade supported by a doctor blade holder;

a doctor blade loading control system in communication with the doctor, the doctor blade loading control system comprising:

a first doctor loading cylinder coupled to the doctor and configured to selectively apply a loading force to the doctor;

a first air line in communication with a load side of the first doctor loading cylinder and configured to deliver air thereto; and a first electronic pressure controller configured to control a loading pressure of the first doctor loading cylinder on the doctor based on a first loading pressure setpoint;

a doctor blade vibration monitoring system in communication with the doctor, the doctor blade vibration monitoring system comprising:

a first accelerometer mounted to the doctor and configured to measure or detect vibration of the doctor blade and to generate and send a first vibration signal; and a first vibration transmitter in communication with the first accelerometer and configured to receive the first vibration signal therefrom; and a system controller in communication with the first electronic pressure controller and the first vibration transmitter, wherein the system controller is configured to receive the first vibration signal from the first vibration transmitter and to automatically adjust the first loading pressure setpoint based on the vibration of the doctor blade.

14. The papermaking machine of claim 13, wherein the first electronic pressure controller is disposed along the first air line and configured to control a first pressure of the air delivered to the load side of the first doctor loading cylinder.

15. The papermaking machine of claim 13, further comprising a user interface in communication with the system controller, the user interface comprising:

a hand indicating controller configured to adjust and indicate the first loading pressure setpoint;

a pressure indicator configured to indicate the loading pressure of the first doctor loading cylinder on the doctor; and a vibration indicator configured to indicate the vibration of the doctor blade.

16. The papermaking machine of claim 13, wherein the doctor blade loading control system further comprises:

a second doctor loading cylinder coupled to the doctor and configured to selectively apply a loading force to the doctor;

a second air line in communication with a load side of the second doctor loading cylinder and configured to deliver air thereto; and a second electronic pressure controller configured to control a loading pressure of the second doctor loading cylinder on the doctor based on a second loading pressure setpoint;

wherein the system controller is in communication with the second electronic pressure controller and configured to automatically adjust the second loading pressure setpoint based on the vibration of the doctor blade.

17. The papermaking machine of claim 13, wherein the doctor blade loading control system further comprises an electronic solenoid valve in communication with the system controller and the first air line and configured to control air flow to the air line, wherein the electronic solenoid valve is positioned upstream of the first electronic pressure controller.

18. The papermaking machine of claim 16, wherein the doctor blade vibration monitoring system further comprises:

a second accelerometer mounted to the doctor and configured to measure or detect vibration of the doctor blade and to generate and send a second vibration signal; and a second vibration transmitter in communication with the second accelerometer and configured to receive the second vibration signal therefrom;

wherein the system controller is in communication with the second vibration transmitter and configured to receive the second vibration signal therefrom.

19. The papermaking machine of claim 16, further comprising a user interface in communication with the system controller, the user interface comprising:

a first hand indicating controller configured to adjust and indicate the first loading pressure setpoint; and a second hand indicating controller configured to adjust and indicate the second loading pressure setpoint.

20. The papermaking machine of claim 13, wherein the doctor is a creping doctor, and wherein the doctor blade is a creping doctor blade configured to remove a fibrous web from the Yankee dryer and to crepe the fibrous web.

* * * * *